US008641438B2

(12) United States Patent
Kamiya et al.

(10) Patent No.: US 8,641,438 B2
(45) Date of Patent: Feb. 4, 2014

(54) ELECTRONIC DEVICE HAVING CARD EDGE CONNECTOR

(75) Inventors: Takashi Kamiya, Anjyo (JP); Taku Iida, Nagoya (JP); Yuji Watanabe, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/403,002

(22) Filed: Feb. 23, 2012

(65) Prior Publication Data

US 2013/0017702 A1 Jan. 17, 2013

(30) Foreign Application Priority Data

Jul. 11, 2011 (JP) ..... 2011-153178
Jul. 11, 2011 (JP) ..... 2011-153179
Jul. 11, 2011 (JP) ..... 2011-153180
Nov. 3, 2011 (JP) ..... 2011-241780
Jan. 12, 2012 (JP) ..... 2012-4334

(51) Int. Cl.
*H01R 13/15* (2006.01)

(52) U.S. Cl.
USPC ..... 439/260; 439/267

(58) Field of Classification Search
USPC ..... 439/260, 267
See application file for complete search history.

(56) References Cited

U.S. PATENT DOCUMENTS 3,555,488 A * 1/1971 McIver ..... 439/260
3,654,592 A * 4/1972 Primorac ..... 439/637
3,697,929 A * 10/1972 Konewko et al. ..... 439/260
3,899,234 A * 8/1975 Yeager et al. ..... 439/267
3,982,807 A * 9/1976 Anhalt et al. ..... 439/260
4,179,177 A * 12/1979 Lapraik ..... 439/267
4,303,294 A * 12/1981 Hamsher et al. ..... 439/267
4,428,635 A * 1/1984 Hamsher et al. ..... 439/265
4,468,073 A * 8/1984 Machcinski ..... 439/266
4,553,803 A * 11/1985 Lapraik et al. ..... 439/260

(Continued)

FOREIGN PATENT DOCUMENTS

EP 0 274 534 7/1988
JP 61-71976 5/1986

(Continued)

OTHER PUBLICATIONS

Office Action (2 pages) dated Jul. 23, 2013, issued in corresponding Japanese Application No. 2011-153178 and English translation (2 pages).

(Continued)

*Primary Examiner* — Ross Gushi
(74) *Attorney, Agent, or Firm* — Nixon & Vanderhye P.C.

(57) ABSTRACT

In an electronic device, a slider is disposed in an insertion opening of a housing of a card edge connector. The slider is movable with an insertion operation of a circuit board into the insertion opening from an initial position before the circuit board is inserted to an insertion completed position where the insertion operation of the circuit board is completed by being pushed by the circuit board. When the slider is at the initial position, terminal projections are supported on a support surface of the slider in a resiliently deformed condition so that contacts are separated from an electrode-formed surface of the circuit board. When the slider is at the insertion completed position, the terminal projections are completely separated from the slider and in a state of applying a spring back force of resilient deformation to the circuit board through the contacts.

31 Claims, 28 Drawing Sheets

(56) References Cited

U.S. PATENT DOCUMENTS

| | | | | |
|---|---|---|---|---|
| 4,553,804 | A * | 11/1985 | Lapraik et al. | 439/267 |
| 4,606,594 | A * | 8/1986 | Grabbe et al. | 439/267 |
| 4,695,111 | A * | 9/1987 | Grabbe et al. | 439/266 |
| 4,842,538 | A * | 6/1989 | Noschese | 439/260 |
| 5,679,018 | A * | 10/1997 | Lopata et al. | 439/260 |
| 5,709,562 | A * | 1/1998 | Kourimsky | 439/267 |
| 6,004,151 | A * | 12/1999 | Hashiguchi | 439/260 |
| 6,132,224 | A * | 10/2000 | Murakami et al. | 439/77 |
| 6,213,804 | B1 * | 4/2001 | Matsumura | 439/267 |
| 6,238,226 | B1 * | 5/2001 | Schempp et al. | 439/260 |
| 6,416,342 | B2 * | 7/2002 | Matsumura | 439/267 |
| 6,494,781 | B2 * | 12/2002 | Fujita et al. | 439/635 |
| 6,527,573 | B2 * | 3/2003 | Stein et al. | 439/260 |
| 6,572,396 | B1 * | 6/2003 | Rathburn | 439/260 |
| 7,004,776 | B2 * | 2/2006 | Otsu et al. | 439/266 |
| 7,014,487 | B2 * | 3/2006 | Ishikawa | 439/267 |
| 7,338,303 | B1 * | 3/2008 | Yi et al. | 439/267 |
| 7,390,208 | B1 * | 6/2008 | Sabo | 439/267 |
| 7,527,513 | B1 * | 5/2009 | Okuyama et al. | 439/267 |
| 7,628,654 | B2 * | 12/2009 | Hori et al. | 439/637 |
| 7,654,845 | B2 * | 2/2010 | Buschle et al. | 439/260 |
| 7,748,988 | B2 * | 7/2010 | Hori et al. | 439/60 |
| 7,931,502 | B2 * | 4/2011 | Iida et al. | 439/630 |
| 8,187,038 | B2 * | 5/2012 | Kamiya et al. | 439/637 |
| 2001/0010980 | A1 * | 8/2001 | Matsumura | 439/267 |
| 2008/0139026 | A1 * | 6/2008 | Sabo | 439/267 |
| 2009/0191760 | A1 * | 7/2009 | Hori et al. | 439/629 |
| 2009/0191764 | A1 * | 7/2009 | Hori et al. | 439/637 |
| 2011/0021078 | A1 * | 1/2011 | Iida et al. | 439/630 |
| 2011/0021080 | A1 * | 1/2011 | Kamiya et al. | 439/637 |

FOREIGN PATENT DOCUMENTS

| | | |
|---|---|---|
| JP | 63-080784 | 5/1988 |
| JP | 01-60377 | 4/1989 |
| JP | 2003-178834 | 6/2003 |
| JP | 2003-178841 | 6/2003 |
| JP | 2004-126792 | 4/2004 |

OTHER PUBLICATIONS

Office Action (2 pages) dated Jul. 23, 2013, issued in corresponding Japanese Application No. 2011-153179 and English translation (2 pages).

Office Action (1 page) dated Sep. 10, 2013, issued in corresponding Japanese Application No. 2012-004334 and English translation (2 pages).

* cited by examiner

ELECTRONIC DEVICE HAVING CARD EDGE CONNECTOR

CROSS REFERENCE TO RELATED APPLICATION

This application is based on Japanese Patent Applications No. 2011-153178 filed on Jul. 11, 2011, No. 2011-153179 filed on Jul. 11, 2011, No. 2011-153180 filed on Jul. 11, 2011, No. 2011-241780 filed on Nov. 3, 2011, and No. 2012-4334 filed on Jan. 12, 2012, the disclosures of which are incorporated herein by reference.

TECHNICAL FIELD

The present invention relates to an electronic device having a card edge connector.

BACKGROUND

A card edge connector generally enables an electric connection between electrodes of a circuit board and harnesses that are extended to an area outside of a housing when an end portion of the circuit board is inserted into the housing. For example, in a card edge connector described in JP2003-178834A, a housing of the card edge connector has terminals. When an edge portion of a circuit board on which electrodes are formed is inserted into the housing as a male terminal, the electrodes are brought into contact with contact portions of the terminals. Thus, the circuit board is electrically connected to the card edge connector.

In such a card edge connector, the contact portions of the terminals are stably in contact with the electrodes by resiliency of the terminals, such as a springing back force of the terminals caused by resiliently deformation of the terminals. Therefore, when the circuit board is inserted into the card edge connector or removing from the card edge connector, if the contact portions of the terminals contact an edge surface of the circuit board and the surface of the circuit board on which the electrodes are formed, plated layers formed on the surfaces of the terminals will be peeled off or the terminals will unexpectedly deformed. Further, the plated layers peeled off from the terminals will cause short-circuit.

SUMMARY

The present invention is made in view of the foregoing matters, and it is an object of the present invention to provide an electronic device having a card edge connector with an enhanced reliability in electric connection.

It is another object of the present invention to provide an electronic device having a card edge connector, which can maintain reliability in electric connection even if a circuit board is inserted into and removed from the card edge connector in many times.

In an electronic device according to an aspect, a card edge connector includes a housing, terminals fixed to the housing, and a slider. A circuit board to be connected to the card edge connector has an electrode-formed surface on which electrodes are formed on at least one side of an edge portion of the circuit board. The housing has an insertion opening for receiving the edge portion of the circuit board. The insertion opening has a first end that opens on an end surface of the housing and a second end opposite to the first end. The insertion opening extends in the housing in a first direction. The housing has insertion opening surfaces that are opposed to each other in a second direction perpendicular to the first direction and defines the insertion opening therebetween. The terminals include housing-fixed portions fixed in the housing and terminal projections extending from the housing-fixed portions and projecting into the insertion opening from at least one of the insertion opening surfaces, which faces the electrode-formed surface of the circuit board, toward the second end of the insertion opening. The terminal projections are arranged in the insertion opening in a third direction perpendicular to the first direction and the second direction. The terminal projections are resiliently deformable and have contacts to be in contact with the electrodes of the circuit board. The slider is disposed in the insertion opening between the contacts of the terminal projections and the second end of the insertion opening with respect to the first direction. Each of the terminal projections includes a slider-contact portion between the contact and a tip end of the terminal projection. The slider is movable from an initial position before the circuit board is inserted into the insertion opening from the first end to an insertion completed position where an insertion of the circuit board is completed by being pushed by the circuit board when the circuit board is inserted into the insertion opening. The slider has a support surface. When the slider is at the initial position, the slider-contact portions of the terminal projections are supported on the support surface of the slider so that the terminal projections are resiliently deformed toward the one of the insertion opening surfaces and the contacts are separated from the electrode-formed surface of the circuit board with respect to the second direction. When the slider is at the insertion completed position, the slider-contact portions are completely separated from the slider, the contacts are in contact with the electrodes, and the terminal projections are in a state of applying a spring back force of resilient deformation to the circuit board through the contacts.

In such a structure, when the slider is at the initial position, the slider-contact portions of the terminal projections are supported on the support surface of the slider and the terminal projections are resiliently deformed toward the insertion opening surface. Therefore, before the circuit board is inserted, the contact is held at a position separated from the electrode-formed surface of the circuit board with respect to the second direction. When the slider is moved to the insertion completed position by inserting the circuit board into the insertion opening, the slider-contact portions of the terminals are completely separated from the support surface. As such, when the circuit board is inserted into the insertion opening, the contacts of the terminal projections are brought into contact with the electrode-formed surface of the circuit board at least after the edge surface of the circuit board passes through the contacts and reaches the slider. Since the contacts are brought into contact with the electrode-formed surface after the edge surface passes through the contact, it is less likely that a plated layer on the surfaces of the terminals will be peeled off and the terminals will be damaged by the edge surface of the circuit board. Also, short-circuit due to the plated layer peeled off from the terminals is restricted. Accordingly, reliability in electric connection improves.

In addition, when the slider is at the insertion completed position, the slider-contact portions of the terminal projections are completely separated from the slider. That is, when the slider is at the insertion completed position, the resiliency of the terminal projections is not applied to the slider. Therefore, the contacts can be stably in contact with the electrodes. Accordingly, reliability in electric connection further improves.

Moreover, the slider-contact portions are completely separated from the slider when the slider is at the insertion completed position. Because there are less effects of vibrations of the terminal projection relative to the slider and a displacement of the terminal projection with respect to the second direction due to creeping of the slider, a change in contact pressure between the contact and the electrode is reduced without increasing a spring force of the terminal projection. Accordingly, the peeling off of the plated layer and damage to the terminal are reduced, improving the reliability in electric connection.

In a case where the electronic device further includes a returning unit to return the slider to the initial position when the circuit board is removed from the card edge connector, the slider-contact portions of the terminal projections are supported on the support surface of the slider. Also in such a case, the peeling off of the plated layer and damage to the terminal projections are reduced. Therefore, the reliability in electric connection is maintained even if the circuit board is inserted into or removed from the card edge connector in many times.

BRIEF DESCRIPTION OF THE DRAWINGS

Other objects, features and advantages of the present invention will become more apparent from the following detailed description made with reference to the accompanying drawings, in which like parts are designated by like reference numbers and in which:

FIG. 20A through FIG. 20D, FIG. 21A through FIG. 21D, FIG. 22A through FIG. 22D, FIG. 23A through 23D and FIG. 24A through FIG. 24D are diagrams illustrating the insertion process according to the third embodiment, in which FIG. 20A, FIG. 21A, FIG. 22A, FIG. 23A and FIG. 24A are diagrams illustrating cross-sectional views of a returning unit for returning the slider, FIG. 20B, FIG. 21B, FIG. 22B, FIG. 23B and FIG. 24B are diagrams illustrating cross-sectional views taken along lines XXB-XXB in FIG. 20A, XXIB-XXIB in FIG. 21A, XXIIB-XXIIB in FIG. 22A, XXIIIB-XXIIIB in FIG. 23A, and XXIVB-XXIVB in FIG. 24A, respectively; FIG. 20C, FIG. 21C, FIG. 22C, FIG. 23C and FIG. 24C are diagrams illustrating cross-sectional views of a positioning unit for positioning the slider; and FIG. 20D, FIG. 21D, FIG. 22D, FIG. 23D and FIG. 24D are diagrams illustrating cross-sectional views taken along lines XXD-XXD in FIG. 20A, XXID-XXID in FIG. 21A, XXIID-XXIID in FIG. 22A, XXIIID-XXIIID in FIG. 23A, and XXIVD-XXIVD in FIG. 24A, respectively FIG. 25A through FIG. 25D, FIG. 26A through FIG. 26D, FIG. 27A through FIG. 27D, and FIG. 28A through FIG. 28D are diagrams illustrating a removal process to remove the circuit board from the card edge connector according to the third embodiment, in which FIG. 25A, FIG. 26A, FIG. 27A, and FIG. 28A are diagrams illustrating cross-sectional views of the returning unit for returning the slider, FIG. 25B, FIG. 26B, FIG. 27B, and FIG. 28B are diagrams illustrating cross-sectional views taken along lines XXVB-XXVB in FIG. 25A, XXVIB-XXVIB in FIG. 26A, XXVIIB-XXVIIB in FIG. 27A, and XXVIIIB-XXVIIIB in FIG. 28A, respectively; FIG. 25C, FIG. 26C, FIG. 27C, and FIG. 28C are diagrams illustrating cross-sectional views of a positioning unit for positioning the slider; and FIG. 25D, FIG. 26D, FIG. 27D, and FIG. 28D are diagrams illustrating cross-sectional views taken along lines XXVD-XXVD in FIG. 25A, XXVID-XXVID in FIG. 26A, XXVIID-XXVIID in FIG. 27A, and XXVIIID-XXVIIID in FIG. 28A, respectively;

DETAILED DESCRIPTION OF EXEMPLARY EMBODIMENTS

Hereinafter, exemplary embodiments will be described with reference to the drawings. Like parts are designated with like reference numbers throughout the exemplary embodiments.

(First Embodiment)

Figure 1:
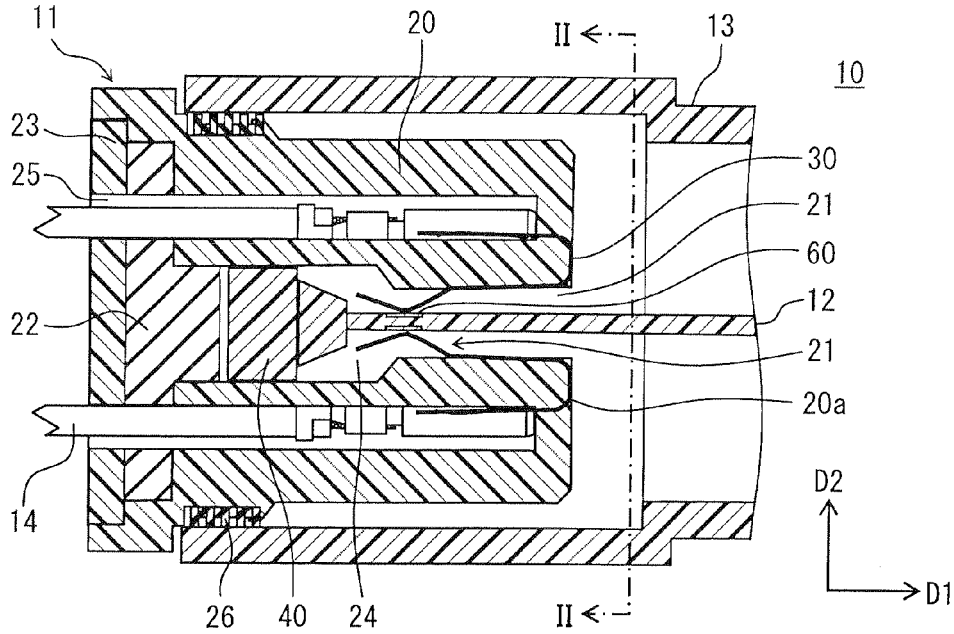
FIG. 1 is a diagram illustrating a cross-sectional view of an electronic device according to a first embodiment.

Referring to FIG. 1, the electronic device 10 includes a card edge connector 11, a circuit board 12, and a case 13 as main components.

The card edge connector 11 enables an electric connection between a harness 14 and the circuit board 12. Thus, the card edge connector 11 serves as a relay device that electrically connects between the circuit board 12 and a device external to the electronic device 10 through the harness 14. The card edge connector 11 includes a housing 20, terminals 30 held in the housing 20, and a slider 40 disposed in the housing 20, as main components. The slider 40 is movable in an insertion opening 21 of the housing 20 in a depth direction D1 of the insertion opening 21.

The depth direction D1 corresponds to a direction in which the circuit board 12 is inserted or removed from the card edge connector 1. For example, the depth direction D1 corresponds to a right and left direction in FIG. 1, and is also referred to as a first direction. Also, a direction perpendicular to the depth direction D1 and corresponding to a width of the insertion opening 21 is referred to as a height direction D2. For example, the height direction D2 corresponds to an up and down direction in FIG. 1, and is also referred to as a second direction. Further, a direction that is perpendicular to the depth direction D1 and the height direction D2 is referred to as a transverse direction D3. For example, the transverse direction D3 corresponds to a direction perpendicular to a paper surface of FIG. 1, and is also referred to as a third direction.

The housing 20 is made of an electrically insulating material. For example, the housing 20 is formed by injection molding of a resin. The housing 20 has the insertion opening 21 to receive the circuit board 12.

Figure 2:
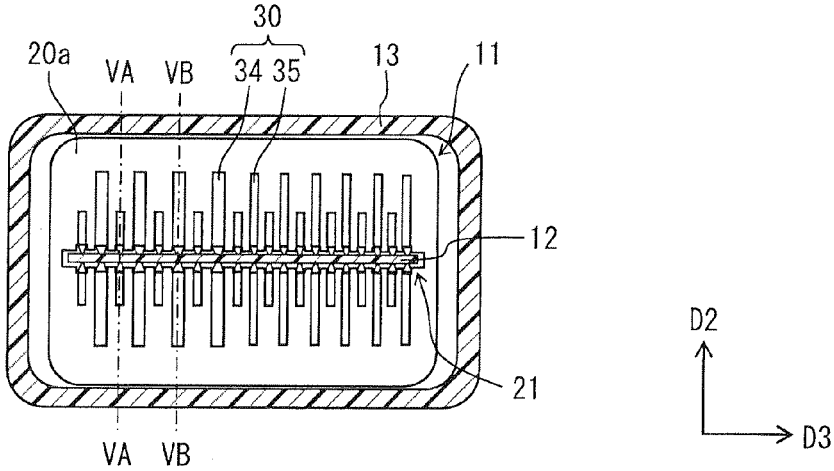
FIG. 2 is a diagram illustrating a cross-sectional view taken along a line II-II in FIG. 1.
Figure 3:
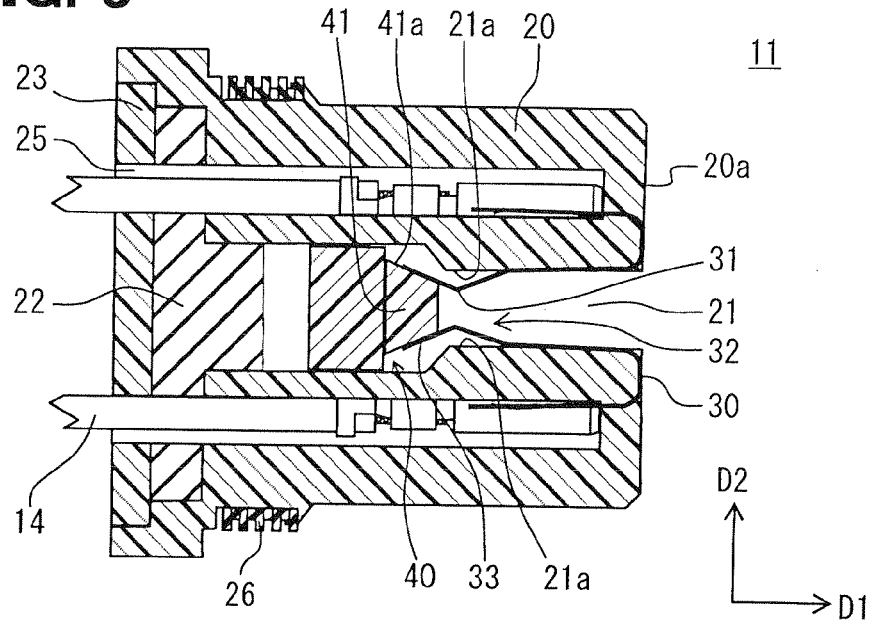
FIG. 3 is a diagram illustrating a cross-sectional view of a card edge connector of the electronic device according to the first embodiment.

As shown in FIG. 1 through FIG. 3, the insertion opening 21 is open at an end surface 20*a* of the housing 20 and has a predetermined depth so as to receive the slider 40 and the circuit board 20 therein. For example, the insertion opening 21 has a first end that opens at the end surface 20*a* of the housing 20 and a second end opposite to the first end with respect to the depth direction D1.

In the present embodiment, the insertion opening 21 is a through hole passing through the housing 20 in the depth direction D1. The second end of the insertion opening 21, which opens at an end surface of the housing 20 opposite to the end surface 20*a*, is covered with a water-proof member 22.

For example, the water proof-member 22 is made of rubber or resin. The water proof-member 22 is held between the housing 20 and a cover 23, which is fixed to the housing 20 so as to cover the end of the insertion opening 21.

Thus, an accommodation space 24 for accommodating the slider 40 and the circuit board 12 is provided in the insertion opening 21 between the water-proof member 22 and the end surface 20*a*. The water-proof member 22 and the cover 23 serve as a cover member of the housing 20.

The accommodation space 24 provides a slider area where the slider 40 can slide with respect to the depth direction D1 and a circuit board space where the circuit board 12 is disposed. The dimension of the accommodation space 24 in the height direction D2 and the dimension of the accommodation space 24 in the transverse direction D3 are determined so that the slider 40 can slide in the slider area and the circuit board 12 can be disposed in the circuit board space.

For example, the dimension of the accommodation space 24 in the height direction D2 can be uniform to be consistent with the height of the slider 40 throughout the depth direction D1, as shown in FIG. 6. As another example, the dimension of the accommodation space 24 in the height direction D2 can be smaller at the circuit board space than the slider area, as shown in FIG. 1 and FIG. 3. In the latter case, positional deviation of the circuit board 12 is restricted with respect to the height direction D2 when the circuit board 12 is inserted into the insertion opening 21.

The housing 20 has an accommodation space 25 to accommodate the harness 14 therein. When the harness 14 is inserted in the accommodation space 25, the harness 14 is electrically connected to the terminal 30.

A sealing member 26 having an annular shape is disposed along an outer surface of the housing 20. The sealing member 26 is made of a silicone rubber, for example. Thus, when the housing 20 is received in the case 13, a clearance between an inner surface of the case 13 and an outer surface of the housing 20 is sealed by the sealing member 26. As such, the sealing member 26 restricts entry of water or the like into the inside of the case 13. Although not illustrated, the housing 20 has an engagement portion on the outer surface to be engaged with the case 13.

For example, the housing 20 may be made by integrating multiple housing members.

The terminals 30 are held in the housing 20. Each of the terminals 30 serves as a relay member that electrically connects the electrode 60 and the harness 14. The terminal 30 is made of a metal material having favorable electric conductivity. For example, the terminal 30 is made by plating phosphor bronze with nickel and further plating with gold.

The terminal 30 is partly fitted in a groove (not shown) of the housing 20 to be fixed by the housing 20. The terminal 30 includes a housing-fixed portion fixed to the housing 20 and a terminal projection 32 that extends from the housing-fixed portion. The terminal projection 32 projects from a surface 21*a* of the housing 20 that forms the insertion opening 21 into the accommodation space 24, and provides a contact 31 that makes contact with the electrode (land) 60 disposed on the edge portion of the circuit board 12. The surface 21*a* of the housing 20 is hereinafter referred to as the insertion opening surface 21*a*.

The terminal projection 32 is resiliently deformable relative to the housing-fixed portion, and the contact 31 is in contact with the electrode 60 in a state where the terminal projection 32 is resiliently deformed.

In the insertion opening 21, the terminal projection 32 extends from the housing-fixed portion in a direction opposite to the end surface 20*a* along the depth direction D1. The multiple terminals 30 are arranged in the transverse direction D3. That is, in the insertion opening 21, the multiple terminal projections 32 are arranged in the transverse direction D3.

Within the terminal projection 32, the contact 31 is the furthest portion disposed furthest from the insertion opening surface 21*a* with respect to the height direction D2. The terminal projection 32 has an inclined portion between the contact 31 and a tip end of the terminal projection 32. The inclined portion is inclined toward the tip end so that a distance between the inclined portion and the surface of the circuit board 12 on which the electrode 60 is formed with respect to the height direction D2 increases toward the tip end. Hereinafter, the surface of the circuit board 12 on which the electrode 60 is formed is referred to as the electrode-formed surface.

Further, a portion of the terminal projection 32 between the contact 31 and the housing-fixed portion is inclined to separate from the electrode-formed surface of the circuit board 12 toward the housing-fixed portion.

The contact 31 is in contact with the electrode 60 of the circuit board 12 in the state where the terminal projection 32 including the contact 31 is resiliently deformed. Therefore, stable contact pressure is achieved between the circuit board 12 and the electrode 60.

In the present embodiment, the terminals 30 are disposed on opposite sides of the insertion opening 21 with respect to the height direction D2. Thus, the terminal projections 32 projects from the insertion opening surfaces 21*a* that are opposed to each other in the height direction D2. The circuit board 12 is fixed by the resiliency (biasing force, spring back force) of the terminal projections 32 disposed on opposite sides of the circuit board 12, the resiliency being produced by the spring deformation (mainly resilient deformation) of the terminal projections 32. As such, the circuit board 12 is held at a middle position of the insertion opening 21 with respect to the height direction D2 by the terminal projections 32 disposed on opposite sides of the circuit board 12.

The terminal projection 32 includes a slider-contact portion 33 adjacent to the tip end, that is, between the contact 31 and the tip end. The slider-contact portion 33 is provided by the inclined portion of the terminal projection 32.

The slider-contact portion 33 is held on the slider 40 from a timing where the circuit board 12 is inserted into the insertion opening 21 to a timing where the slider 40 is pushed toward the second end of the insertion opening 21 by the circuit board 12. When the slider 40 is pushed to the second end of the insertion opening 21 by the circuit board 12, the slider-contact portion 33 is separated from the slider 40.

Therefore, in a state before the circuit board 12 is inserted into the insertion opening 21, the slider-contact portion 33 is held on the slider 40. Further, in a state where the insertion of the circuit board 12 is completed, the slider-contact portion 33, that is, the terminal 30 is completely separated from the slider 40 and is in a non-contact condition.

When the slider-contact portion 33 is held on the slider 40, the terminal projections 32 is urged toward the insertion opening surface 21*a* in which the terminal 30 is fixed. Thus, the contact 31 is moved to a position separated from the electrode-formed surface of the circuit board 12.

In the present embodiment, the slider-contact portion 33 is provided in a predetermined range of the inclined portion from the tip end of the terminal projection 32. Thus, a surface of the slider-contact portion 33, which contacts the slider 40, is inclined so that a distance between the surface of the slider-contact portion 33 and the electrode-formed surface of the circuit board 12 reduces toward the end surface 20*a*.

In the present embodiment, the terminals 30 include power terminals 34 for power transmission and signal terminals 35 for signal transmission, as shown in FIG. 2. Each of the signal terminals 35 has a sectional area smaller than that of each of the power terminals 34.

Each of the terminals 30 has a connection end exposed to the accommodation space 25 of the housing 20 to be connected to the harness 14. The accommodation space 25 has an opening on the end surface of the housing 20 opposite to the end surface 20*a* with respect to the depth direction D1. Thus, when the harness 14 is inserted into the accommodation space 25, the circuit board 12 is electrically connected to the harness 14 through the terminal 30. As another example, the terminal 30 may be integral with the harness 14.

The slider 40 is provided to restrict the contact 31 from contacting the circuit board 12 at least until an end of the electrode 60 reaches a position of the contact 31 with respect to the depth direction D1, when the circuit board 12 is inserted into the insertion opening 21. A material of the slider 40 is not particularly limited. However, because the slider 40 contacts the slider-contact portion 33 of the terminal 30, a contact portion of the slider 40 is made of a resin, for example. In the present embodiment, for example, the slider 40 is a resin molded member made using a molding die.

The slider 40 is disposed further from the end surface 20*a* than the contacts 31 of the terminals 30 in the inside of the insertion opening 21. That is, the slider 40 is disposed in an area between the second end of the insertion opening 21 and the contacts 31. The slider 40 is slidable with respect to the depth direction D1 by receiving an external force.

Specifically, the slider 40 is slidable toward the second end of the insertion opening 21 with respect to the depth direction D1 from an initial position before the circuit board 12 is inserted in the insertion opening 21 to an insertion completed position where the insertion of the circuit board 12 is completed and the contact portions 31 are in contact with the electrodes 60 and. The slider 40 moves from the initial position to the insertion completed position by being pushed by the circuit board 12 when the circuit board 12 is inserted into the insertion opening 21.

When the slider 40 is at the initial position, the slider 40 supports the slider-contact portions 33 so that the terminal projections 32 are expanded, that is, urged toward the corresponding insertion opening surfaces 21*a*. Thus, each of the contact portions 31 is held at a position separated from the electrode-formed surface of the circuit board 12, that is, at a position without contacting the electrode-formed surface of the circuit board 12. In other words, the slider 40 is held at the initial position due to the spring back force of the resilient deformation of the terminal projections 32.

When the slider 40 is pushed to the insertion completed position, the slider-contact portions 33 of the terminal projections 32 are completely separated from the slider 40. That is, the slider 40 is pushed to a position where the slider-contact portions 33 cannot be supported by the slider 40 by the circuit board 12. Therefore, when the slider 40 is at the insertion completed position, the terminal projections 32, which are not supported on the slider 40, are in a state of applying the spring back force caused by the resilient deformation to the circuit board 12 through the contacts 31.

Figure 4:
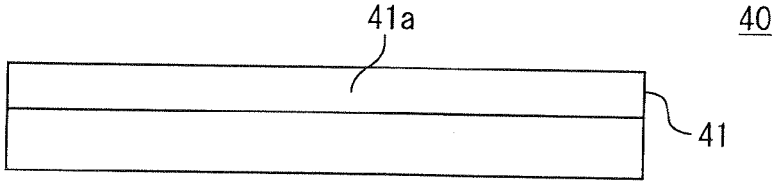
FIG. 4 is a diagram illustrating a plan view of a slider of the card edge connector, when viewed along a height direction, according to the first embodiment.

In the present embodiment, the slider 40 has a predetermined width in the transverse direction D3 so as to support the slider-contact portions 33 of all the terminals 30, which are arranged in the transverse direction D3, as shown in FIG. 4. The slider 40 includes a support portion 41 at a position adjacent to the end surface 20*a* so as to support the slider-contact portions 33. The support portion 41 has support surfaces 41*a* to support the slider-contact portions 33.

The support surfaces 41*a* are inclined so that a distance between the support surfaces 41*a* reduces toward the first end of the insertion opening 21. That is, each of the support surfaces 41*a* is inclined so that a distance between the support surface 41*a* and an imaginary plane (center plane) including a centerline CL that passes through the center of the insertion opening 21 in the depth direction D1 and the transverse direction D3 reduces toward the first end of the insertion opening 21.

A first end of each of the support surfaces 41*a* adjacent to the end surface 20*a* is located closer to the imaginary plane CL than the tip end of the terminal projection 30 in the state where the slider-contact portion 33 is not supported on the slider 40. A second end of the support surface 41*a* further from the end surface 20*a* is located further from the imaginary plane than the tip end of the terminal projection 30 in the state where the slider-contact portion 33 is not supported on the slider 40.

In other words, the slider 40 has a tapered shape so that a dimension with respect to the height direction D2 gradually increases from its first end adjacent to the first end of the insertion opening 21 toward its second end adjacent to the second end of the insertion opening 21. Further, the dimension of the first end of the support portion 41 with respect to the height direction D2 is greater than the thickness of the circuit board 12 and is less than the distance between the tip ends of the opposed terminal projections 32. The dimension of the second end of the support portion 41 with respect to the height direction D2 is greater than the distance between the tip ends of the opposed terminal projections 32.

The slider 40 is disposed in the insertion opening 21 in the following manner.

The slider 40 is inserted into the insertion opening 21 of the housing 20 in which the terminals 30 have been fixed, from the second end of the insertion opening 21 opposite to the end surface 20*a*. When the slider 40 is moved toward the first end of the insertion opening 21, the first end of the support portion 41 is received between the opposed slider-contact portions 33.

When the slider 40 is further moved toward the first end of the insertion opening 21, the support portion 41 contacts the slider-contact portions 33. Thus, the slider 40 is placed to the initial position while expanding the opposed terminal projections 32 toward the opposed insertion opening surfaces 21*a* by the support portion 41. The slider 40 is held at the initial position due to the spring back force of the resiliently deformed terminal projections 32.

As described above, since the insertion opening 21 is formed as the through hole, the structure where the slider-contact portions 33 of the terminal projections 32, which project toward the second end of the insertion opening 21 from the insertion opening surfaces 21, are supported on the slider 40 is achieved by simply inserting the slider 40 into the insertion opening 21 from the second end of the insertion opening 21. In addition, because the slider 40 is brought into contact with the slider-contact portions 33 from the end opposite to the contacts 31, it is less likely that the contacts 31 will be damaged by the slider 40.

After the slider 40 is inserted into the insertion opening 21, the second end of the insertion opening 21 is covered with the water-proof member 22 and the cover 23 as a cover member. Therefore, the terminals 30 and the slider 40 are protected.

The circuit board 12 has the electrodes 60 on both surfaces thereof. Therefore, electric connection paths through the card edge connector 11 can be efficiently increased, as compared with a circuit board having electrodes only on one surface.

In the above described example, the circuit board 12 is held by the spring back force of the terminals 30 disposed on opposite sides of the circuit board 12. As another example, the circuit board 12 can be held between the terminals 30 that are disposed on only one side of the circuit board 30 and a support member that are disposed on a side opposite to the terminals 30 and does not cause a spring back force due to the resilient deformation.

The electrodes 60 are arranged in rows in the depth direction D1, and each row extending in the transverse direction D3. Further, the electrodes 60 are staggered with respect to the transverse direction D3 between the adjacent rows.

Figure 5A:
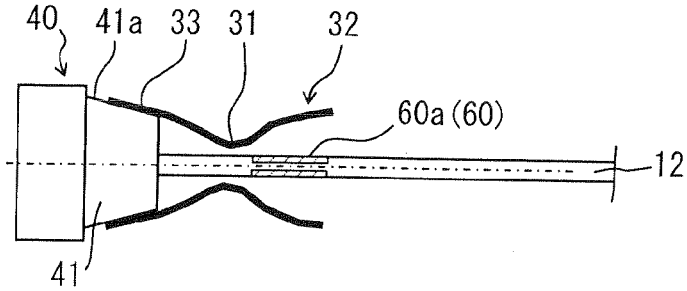
FIG. 5A is a diagram illustrating a positional relationship between a land, a terminal and the slider of the electronic device, corresponding to a cross-sectional view taken along a line VA-VA in FIG. 2, according to the first embodiment.
Figure 5B:
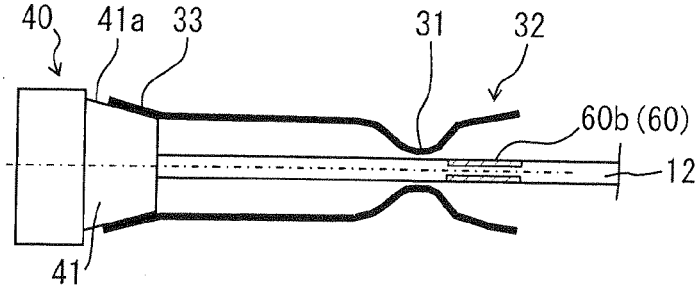
FIG. 5B is a diagram illustrating a positional relationship between a land, a terminal and the slider of the electronic device, corresponding to a cross-sectional view taken along a line VB-VB in FIG. 2, according to the first embodiment.

For example, the electrodes 60 are arranged in two rows on the circuit board 12, as shown in FIG. 5A and FIG. 5B. Electrodes 60*a* in the first row are further from the end surface 20*a* than the electrodes 60*b* in the second row. The electrodes 60*a* in the first row are staggered from the electrodes 60*b* in the second row with respect to the transverse direction D3. That is, the multiple electrodes 60 are arranged in a staggered manner.

The position of the contact 31 is different between the terminals 30 to correspond to the position of the corresponding electrode 60. For example, the length of the terminal projection 32 is different between the terminals 30 to correspond to the position of the corresponding electrode 60. Thus, multiple types of the terminals 30 having different shapes are prepared with respect to the number of the rows of the electrodes 60, and the slider-contact portions 33 of all the terminals 30 are supported on the slider 40 at the same position with respect to the depth direction D1, when the slider 40 is located at the initial position.

In this way, even when the electrodes 60 are arranged in rows, the shape of the slider 40 can be simplified by differentiating the length of the terminal projections 32. It is to be noted that only the terminal projections 32 of the terminals 30 are illustrated in FIG. 5A and FIG. 5B, for the purposed of clarity.

The case 13 has a substantially cap shape providing an inner space therein. The housing 20 can be received in the case 13 with the circuit board 12 up to a position deeper than a displaceable range of the slider 40. The case 13 may be provided by a single member. Alternatively, the case 13 may be provided by connecting multiple members.

Next, an operation to insert the circuit board 12 to the card edge connector 11 will be described.

Figure 6A:
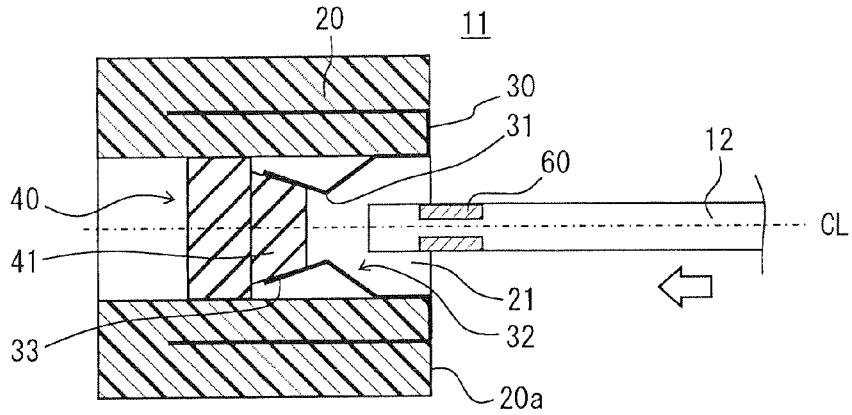
FIG. 6A is a diagram illustrating a cross-sectional view of the card edge connector when the slider is at an initial position during an insertion process to insert a circuit board into the card edge connector, according to the first embodiment.

As shown in FIG. 6A, when the slider 40 is at the initial position before being pushed by the circuit board 12, the slider-contact portions 33 of the terminals 30 are supported on the contact surfaces of the slider 40. In this state, the terminal projections 32 are expanded, and the contacts 31 are held at the positions away from the electrode-formed surfaces of the circuit board 12.

Therefore, the slider 40 restricts the contacts 31 from contacting the circuit board 12 at least until the circuit board 12 is brought into contact with the slider 40. In other words, the slider 40 restricts the contacts 31 from contacting the circuit board 12 at least until the edge surface of the circuit board 12 passes through the contacts 31 with respect to the depth direction D1.

In addition, the slider 40 is held at the initial position by the spring back force of the resiliently deformed terminal projections 32 until the circuit board 12 is brought into contact with the slider 40.

When the circuit board 12 is further moved toward the second end of the insertion opening 21 from the position shown in FIG. 6A, the circuit board 12 reaches the first end of the support portion 41 of the slider 40.

When the circuit board 12 is further moved, the slider 40 is pushed by the circuit board 12 toward the second end of the insertion opening 21. That is, the slider 40 begins to move with the circuit board 12. At this time, the slider-contact portions 33 slide toward the first end of the support portion 41 along the inclined support surfaces 41*a* with the movement of the slider 40. Thus, the slider-contact portions 33 gradually separate from the support portion 41. With this, the contacts 31 of the terminal projections 32 gradually move toward the electrode-formed surfaces of the circuit board 12 with respect to the height direction D2.

Figure 6B:
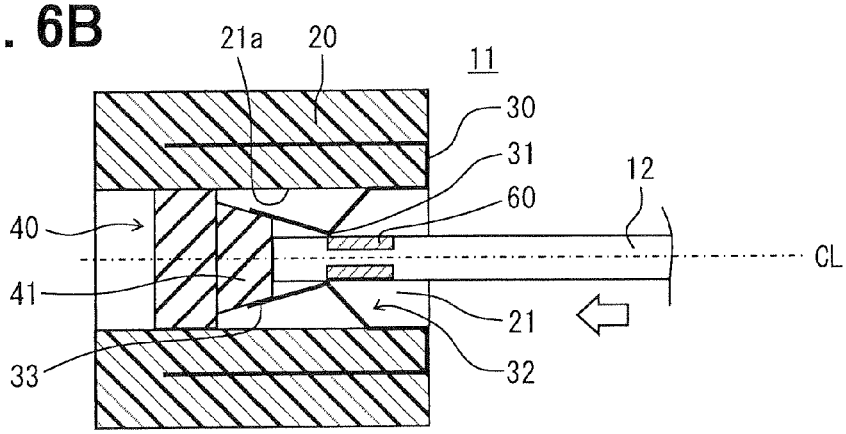
FIG. 6B is a diagram illustrating a cross-sectional view of the card edge connector when the circuit board is brought into contact with the slider during the insertion process, according to the first embodiment.

In the present embodiment, as shown in FIG. 6B, the contacts 31 are brought into contact with the electrode-formed surfaces (i.e., electrodes 60) of the circuit board 12 when the ends of the electrodes 60 reach the contacts 31 with respect to the depth direction D1.

Figure 6C:
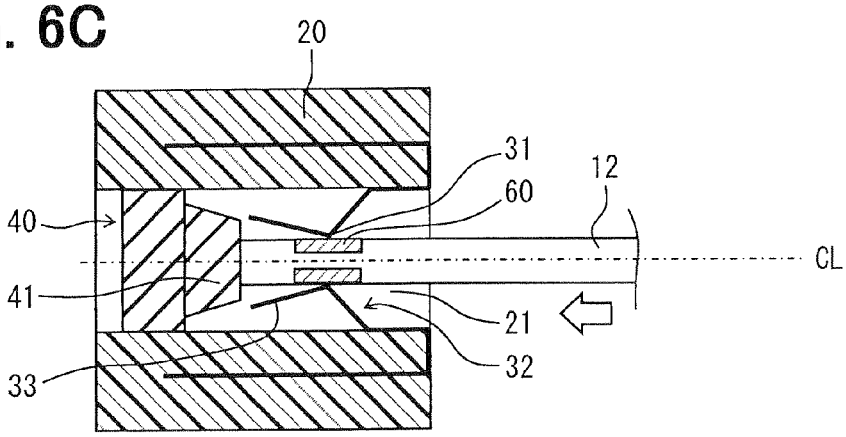
FIG. 6C is a diagram illustrating a cross-sectional view of the card edge connector when the slider is at an insertion completed position, according to the first embodiment.

When the circuit board 12 is further inserted from the position shown in FIG. 6B, the slider 40 is pushed by the edge surface of the circuit board 12. Thus, the slider-contact portions 33 are completely separated from the slider 40, as shown in FIG. 6C. That is, the slider 40 is in the non-contact state. The contacts 31 are placed to the substantially center of the electrodes 60, and the insertion of the circuit board 12 is completed. At this time, the slider 40 is at the insertion completed position.

In the present embodiment, in an initial state, the terminal projections 32 are expanded due to the slider-contact portions 33 being supported on the slider 40, and the contacts 31 are held at positions separated from the corresponding electrode-formed surfaces of the circuit board 12. Therefore, the contacts 31 do not contact the circuit board 12 at least until the edge surface of the circuit board 12 passes through the contacts 31 and reaches the slider 40 with respect to the depth direction D1.

As such, it is less likely that the plated layer on the surfaces of the terminals will be peeled off and/or the terminals 30 will be damaged. Further, short-circuit due to the peeled materials is reduced. Accordingly, reliability in electric connection improves.

The slider-contact portions 33 of the terminals 30 are completely separated from the slider 40 when the slider 40 is at the insertion completed position. In the state where the terminals 30 are completely separated from the slider 40, the spring back force of the terminal projections 32 are not applied to the slider 40. Therefore, the contacts 31 can be in stably contact with the electrodes 60 by the spring back force of the resiliently deformed terminal projections 32. Accordingly, the reliability in electric connection further improves.

In the card edge connector 10, the circuit board 12 is electrically connected as the contact 31 of the terminal projection 32 is in contact with the electrode 60 of the circuit board 12. Therefore, it is preferable to keep contact pressure between the terminal 31 and the electrode 60 uniform. For example, in a structure where the slider-contact portion 33 is in contact with the support surface 41*a* of the slider 40 when the contact 31 is in contact with the electrode 60, if the housing 20 and the circuit board 12 are relatively vibrated due to an external force applied to the housing 20, the terminal projection 32 vibrates about the contact portion with the slider 40, resulting in a change in the contact pressure between the contact 31 and the electrode 60. Also, if an internal stress is changed due to creeping of the slider 40 over time, the position of the slider-contact portion 33 supported by the slider 40 will be changed, resulting in the change in the contact pressure. In such a structure, therefore, it is necessary to increase a spring force of the terminal relative to the circuit board so as to restrict the change in the contact pressure.

In the present embodiment, on the other hand, the terminals 30 are completely separated from the slider 40 in the state where the contacts 31 are in stably contact with the electrodes 60, that is, where the slider 40 is at the insertion completed position. Therefore, because vibrations of the terminal projections 32 relative to the slider 40 and displacement of the terminal projections 32 with respect to the height direction D2 due to creeping of the slider 40 are reduced, a change in the contact pressure between the contacts 31 and the electrodes 60 can be reduced without increasing the spring force of the terminal projections 32. Accordingly, the peeling off of the plated layer on the surfaces of the terminals 30, the damage to the terminals 30, and the short-circuit due to the plated layer peeled off from the terminals 30 can be further reduced.

Next, a relationship between the amount of displacement of the slider 40 and the spring back force (spring load) produced by the resiliently deformed terminals 30 will be described with reference to FIG. 7A through 7C.

Figure 7A:
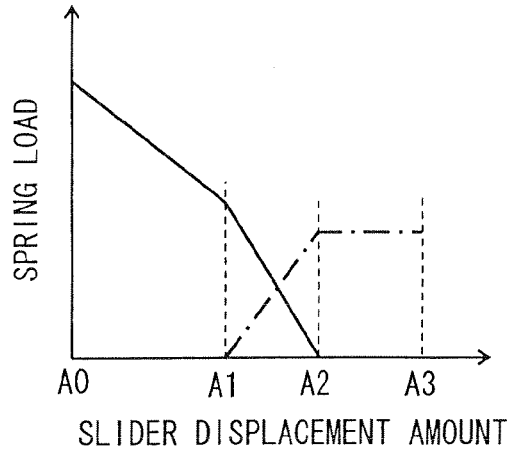
FIG. 7A is a diagram illustrating a relationship between the amount of displacement of the slider and a spring load of the terminal according to the first embodiment.
Figure 7B:
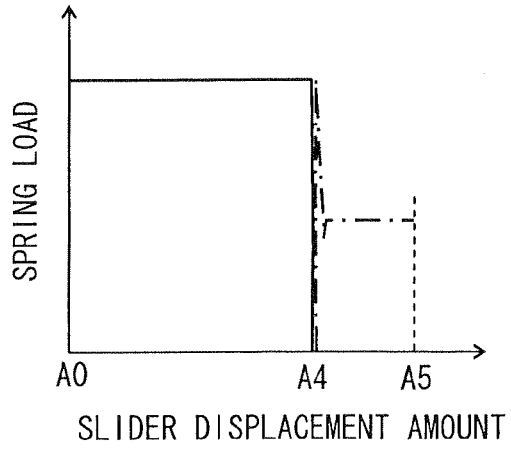
FIGS. 7B and 7C are diagrams illustrating a relationship between the amount of displacement of a slider and a spring load of a terminal as comparative examples.
Figure 7C:
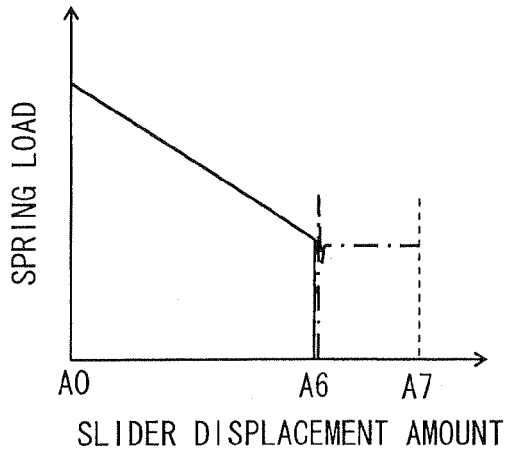

In FIG. 7A through 7C, a solid line represents the load applied to the slider 40, and a dashed-chain line represents the load applied to the circuit board 12. FIG. 7A illustrates a change in the spring back force of the terminal projection 32 of the present embodiment where the support surface 41*a* of the slider 40 and the slider-contact portion 33 of the terminal projection 32 are inclined. FIG. 7B illustrates a change in the spring back force of the terminal projection 32 of a comparative example where the support surface of the slider 40 and the slider-contact portion of the terminal projection extend parallel to the centerline CL. FIG. 7C illustrates a change in the spring back force of the terminal projection 32 of another comparative example where the support surface 41*a* of the slider 40 and the slider-contact portion 33 of the terminal projection 32 are inclined.

Further, "A0" in the horizontal axis represents a state where the amount of displacement of the slider 40 is zero, that is, the slider 40 is at the initial position, and "A3", "A5" and "A7" represent the amount of displacement of the slider 40 when the slider 40 is at the insertion completed position.

In the present embodiment, the support surface 41*a* of the slider 40 and the slider-contact portion 33 of the terminal projection 32 respectively have the inclined shape. Therefore, when the slider 40 is at the initial position, the contact 31 of the terminal projection 32 is at the terminal initial position most separated from the electrode-formed surface of the circuit board 12 with respect to the height direction D2. When the slider 40 moves toward the second end of the insertion opening 21, the contact 31 approaches the electrode-formed surface of the circuit board 12 from the terminal initial position and contacts the electrode 60.

As such, as shown in FIG. 7A, the load applied to the slider 40, that is, the spring back force applied to the slider 40 gradually reduces from the point A0 where the amount of displacement is zero to the point A1 where the contact 31 is brought into contact with the electrode-formed surface of the circuit board 12, that is, the electrode 60. Further, the load applied to the slider 40 gradually reduces from the point A1 to the point A2 where the slider-contact portion 33 is completely separated from the slider 40.

On the other hand, in the comparative example shown in FIG. 7B, the contact 31 is already in contact with the electrode-formed surface of the circuit board 12, that is, the electrode 60 when the amount of displacement is at the point A0. The load applied to the slider 40 hardly changes from the point A0 to the point A4 where the slider-contact portion 33 completely separates from the slider 40.

Accordingly, in the present embodiment, a load (impact) instantaneously applied to the circuit board 12 when the terminal projection 32 separates from the slider 40 can be reduced.

In the present embodiment, as shown in FIG. 7A, at the point A1, which is before the slider-contact portion 33 completely separated from the slider 40, the contact 31 is brought into contact with a portion of the electrode 60, which has a predetermined width in the depth direction D1. Further, in a period from the point A1 to the point A4 where the slider 40 is at the insertion completed position, the contact 31 moves along the surface of the electrode 60. That is, the contact 31 wipes the surface of the electrode 60.

In such a structure, the spring back force is dispersed not only to the slider 40 but also to the circuit board 12 from the timing A1 where the contact 31 is brought into contact with the electrode 60. Also, the load applied to the circuit board 12 gradually increases with the gradual decrease in the load applied to the slider 40.

Therefore, the degree of decrease in the load applied to the slider 40 is large relative to the amount of displacement of the slider 40, and the load applied to the slider 40 is largely reduced at a timing where the terminal projection 32 is completely separated from the slider 40.

FIG. 7C illustrates the change in the spring back force in the structure where the contact 31 is brought into contact with the electrode-formed surface of the circuit board 12, that is, the electrode 60 as well as the slider-contact portion 33 is completely separated from the slider 40 at the point A6, though the support surface 41*a* of the slider 40 and the surface of the slider-contact portion 33 have the inclined shape. In the comparative example shown in FIGS. 7B and 7C, the degree of decrease of the load applied to the slider 40 with respect to the amount of displacement of the slider 40 is smaller than that in FIG. 7A.

Therefore, in the present embodiment, the load (impact) rapidly or instantaneously applied to the circuit board 12 is effectively reduced, as compared with the comparative examples.

Further, since the contact 31 is slightly moved along the surface of the electrode 60, a wiping distance for breaking an insulation coating on the surface of the electrode 60 and removing foreign materials on the surface of the electrode 60 can be ensured.

In addition, since the support surface 41*a* of the slider 40 and the surface of the slider-contact portion 33 are respectively inclined, the slide-contact portion 33 easily moves along the support surface 41*a* of the slider 40. Therefore, a force required to insert the circuit board 12 can be educed.

The above advantageous effects can be achieved also in a structure where at least one of the support surface 41*a* and the surface of the slider-support portion 33 is inclined toward the first end of the insertion opening 21.

(Modifications)

It is not always necessary that both of the support surface 41*a* of the slider 40 and the slider-contact portion 33 of the terminal projection 32 are inclined. It may be possible that one of the support surface 41*a* of the slider 40 and the surface of the slider-contact portion 33 does not have the inclined shape. It may be configured that the insertion of the circuit board 12 is completed immediately after the slider-contact portion 33 is completely separated from the support surface 41*a*.

Figure 8A:
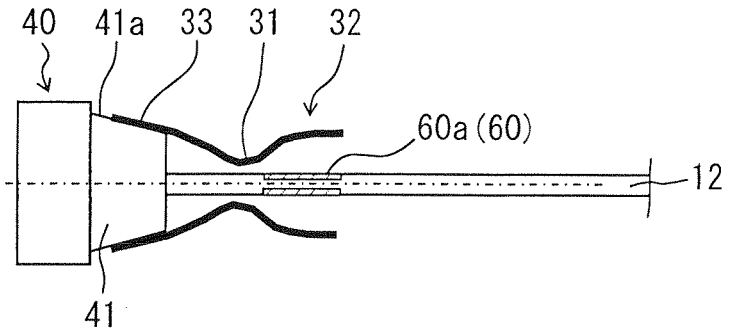
FIG. 8A and FIG. 8B are diagrams illustrating cross-sectional views of the card edge connector according to a modification of the first embodiment.
Figure 8B:
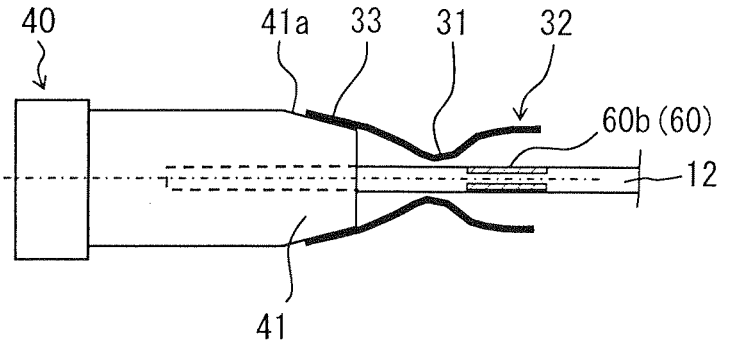

In the structure where the electrodes 60 are arranged in multiple rows in the depth direction D1, and the electrodes 60 are staggered between the rows in the transverse direction D3, as shown in FIG. 8A and FIG. 8B, the length of the support portion 41 of the slider 40 may be differentiated in the depth direction D1 to correspond to the positions of the respective rows of the electrodes 60 (60*a*, 60*b*), while maintaining the length of the terminal projections 32 uniform.

FIG. 8A and FIG. 8B are side views corresponding to the side views of FIG. 5A and FIG. 5B, respectively. In such a case, since the slider 40 has different length corresponding to the positions of the respective rows of the electrodes 60 (60*a*, 60*b*), the terminals 30 having the same shape can be used for the different rows.

In the above structure, the slider 40 is projected depending on the position of the corresponding electrode 60 (60*a*, 60*b*), and the projected portion of the slider 40 is formed with a groove to receive the circuit board 12, as shown by a dashed line in FIG. 8B. The slider-contact portion 33 of the terminal projection 32 that makes contact with the electrode 60*b* is supported on the projected portion of the slider 40.

Figure 9:
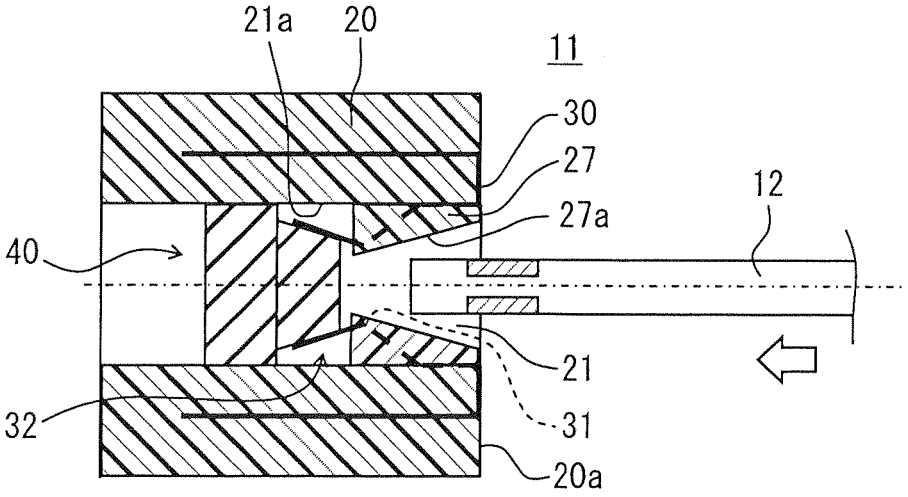
FIG. 9 is a diagram illustrating a cross-sectional view of the card edge connector according to another modification of the first embodiment.

In an example shown in FIG. 9, the housing 20 has a protection wall 27 next to the contact 31 with respect to the transverse direction D3. In such a case, although the protection wall 27 extends to a position adjacent to the electrode-formed surface of the circuit board 12, but is separated from the electrode-formed surface of the circuit board 12 with respect to the height direction D2. The protection wall 27 extends to the position adjacent to the electrode formed surface of the circuit board 12 with respect to the height direction D2 so that the contact 31 at the contact initial position is covered with the protection wall 27.

In such a case, even if the circuit board 12 is warped or the position of the circuit board 12 is deviated in the height direction D2 when the circuit board 12 is inserted, the protection wall 27 restricts the circuit board 12 from contacting the contact 31 when the circuit board 12 passes through the contact 31. As such, the reliability in electric connection improves. Further, the warpage of the circuit board 12 can be corrected by the protection wall 27.

In addition, the protection wall 27*a* extends from a position adjacent to the end surface 20*a* in the depth direction D1, and an opposed surface 27*a* of the protection wall 27, which is opposed to the electrode-formed surface of the circuit board 12, is inclined toward the electrode-formed surface as a function of distance from the end surface 20*a*. Therefore, the circuit board 12 can be guided along the opposed wall 27*a* to a desired position with respect to the height direction D2. That is, the protection wall 27 also has a function of positioning the circuit board 12 to the desired position.

Figure 10A:
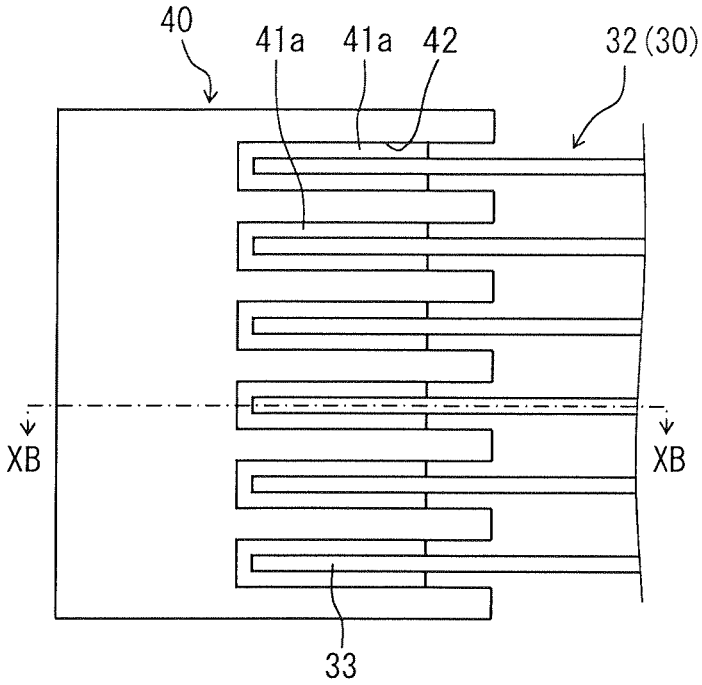
FIG. 10A is a diagram illustrating a plan view of the slider and terminals according to further another modification of the first embodiment.
Figure 10B:
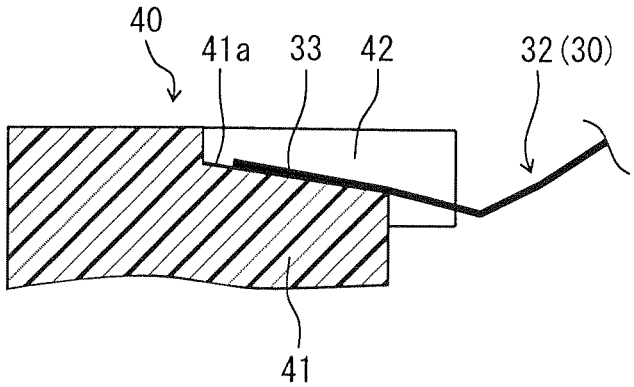
FIG. 10B is a diagram illustrating a cross-sectional view of a part of the slider and the terminal shown in FIG. 10A.

In an example shown in FIG. 10A and FIG. 10B, the support portion 41 of the slider 40 is formed with grooves 42 at positions corresponding to the slider-contact portions 33 of the terminal projections 32. The support surfaces 41*a* are provided by the bottom surfaces of the grooves 42.

In such a structure, when the slider 40 is inserted into the housing 20, for example, when the card edge connector 11 is manufactured, the slider-contact portions 33 of the terminal projections 32 are disposed on the support surfaces 41*a*, respectively. Therefore, it is less likely that the adjacent slider-contact portions 33 will contact each other in the transverse direction D3. As such, peeling off of the plated layer and unexpected deformation of the terminal projections 32 are reduced.

(Second Embodiment)

In a second embodiment, the electronic device 10 has a positioning unit for positioning the slider 40 to the initial position, in addition to the structure similar to the first embodiment. The positioning unit is provided by an engagement projection and an engagement recess. The engagement projection is disposed in one of the slider 40, the housing 20 and the terminals 30. The engagement recess is disposed in the other of the slider 40, the housing 20 and the terminals 30. The engagement projection is resiliently deformable, and is engaged with the engagement recess when the slider 40 is at the initial position.

Figure 11A:
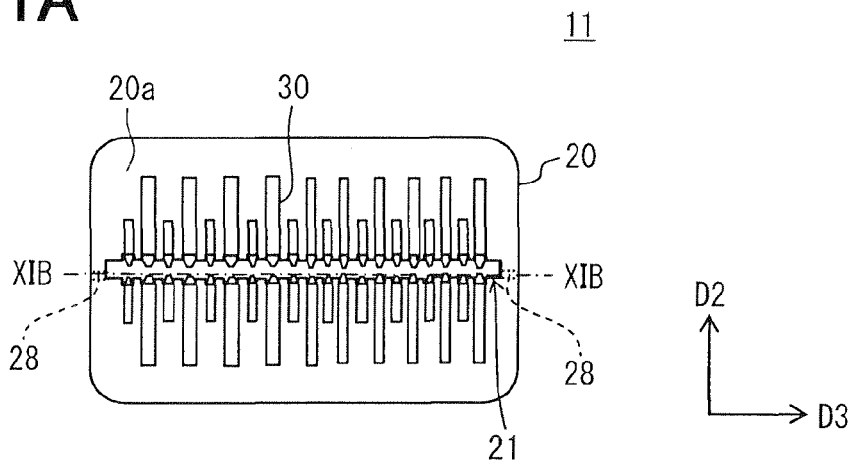
FIG. 11A is a diagram illustrating an end view of a card edge connector of an electronic device, when viewed along a depth direction, according to a second embodiment.
Figure 11B:
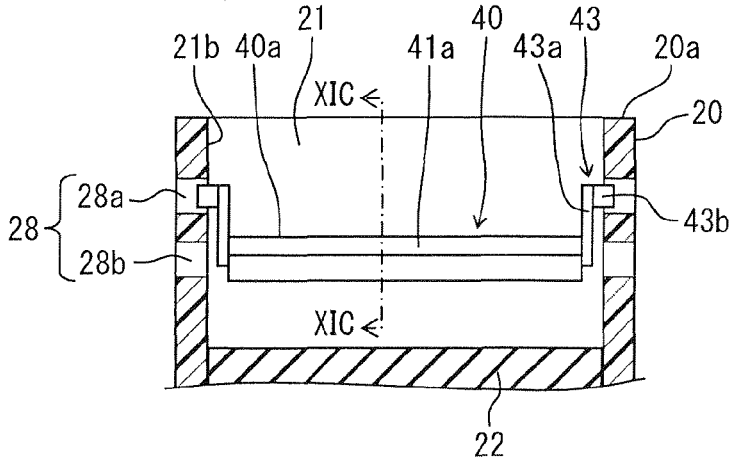
FIG. 11B is a diagram illustrating a cross-sectional view of the card edge connector taken along a line XIB-XIB in FIG. 11A.
Figure 11C:
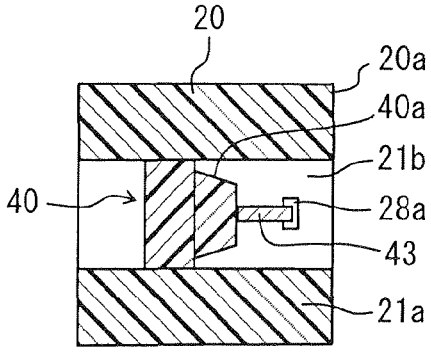
FIG. 11C is a diagram illustrating a cross-sectional view of the card edge connector taken along a line XIC-XIC in FIG. 11B.

FIG. 11A through 11C illustrate a schematic structure of the card edge connector 11 of the electronic device 10 according to the present embodiment. In FIG. 11A through FIG. 11C, the case 13 is not illustrated for the purpose of clarity. FIG. 11B illustrates a cross-sectional view taken along a plane passing through two through holes 28 (28*a*, 28*b*) as the engagement recess in FIG. 11A, and in which the slider 40 located in the insertion opening 21 of the housing 20 is illustrated as a plan view.

As shown in FIG. 11A through FIG. 11C, the housing 20 has the through holes 28 as the engagement recess. The through holes 28 are disposed on side walls 21*b* of the housing 20. The through holes 28 are located at the same positions between the two side walls 21*b* opposed to each other in the transverse direction D3.

Two through holes 28*a*, 28*b* are arranged in the depth direction D1 in each of the side walls 21*b*. A first through hole 28*a*, which is closer to the end surface 20*a* than a second through hole 28*b*, is provided to dispose the slider 40 to the initial position. The second through hole 28*b* is provided to dispose the slider 40 to the insertion completed position.

The slider 40 has a slider body 40*a* and first arms 43 as the engagement projection projecting from a slider body 40*a*. The slider body 40*a* is a part of the slider 40 and corresponds to the slider 40 of the first embodiment.

Each of the first arms 43 includes a spring portion 43*a* and a locking portion 43*b*. The spring portion 43*a* extends from the slider body 40*a* toward the end surface 20*a* along the depth direction D1, and is resiliently deformable in the transverse direction D3. The locking portion 43*b* extends from the spring portion 43*a* in a direction opposite to the slider body 40*a* with respect to the transverse direction D3, and is engaged with the through hole 28.

Other structures of the second embodiment are similar to the first embodiment.

Next, an operation to insert the circuit board 12 into the above described card edge connector 11 will be described.

Figure 12A:
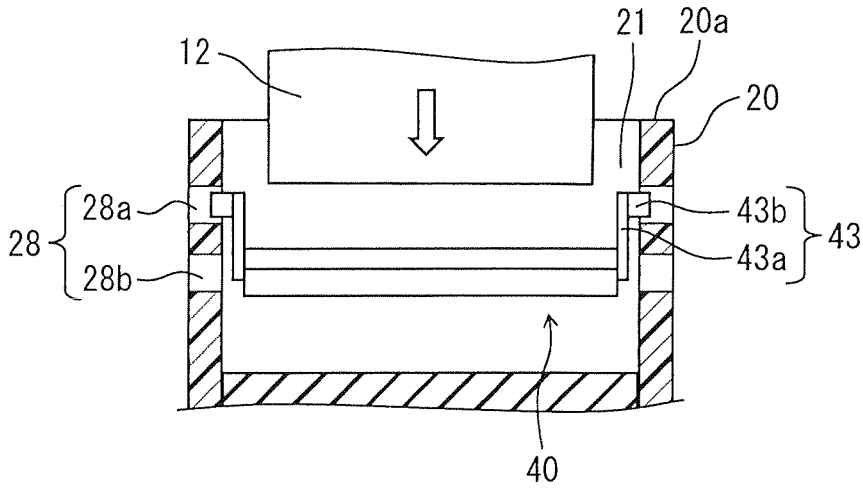
FIG. 12A is a diagram illustrating a cross-sectional view of the card edge connector when the slider is at an initial position during an insertion process to insert a circuit board into the card edge connector, according to the second embodiment.

FIG. 12A illustrates an initial state where the circuit board 12 has not been in contact with the slider body 40*a* (slider 40) yet.

In the initial state, the locking portions 43*b* of the first arms 43 are engaged with the first through holes 28*a*. That is, the slider body 40*a* is fixed at the initial position. Although not illustrated, in the initial state, the slider-contact portions 33 of the terminal projections 32 are supported on the support surface 41*a* of the slider body 40*a*. Thus, the terminal projections 32 are expanded toward the insertion opening surface 21*a*, and the contacts 31 are located at the position separated from the electrode-formed surface of the circuit board 12 with respect to the height direction D2.

When the circuit board 12 is inserted in the insertion opening 21 from the initial state shown in FIG. 12A, the circuit board 12 reaches the slider body 40*a*. When the circuit board 12 is further inserted in the insertion opening 21, the slider body 40*a* is pushed by the circuit board 12, and thus the slider body 40*a* is displaced toward the second end of the insertion opening 21 with the circuit board 12.

Figure 12B:
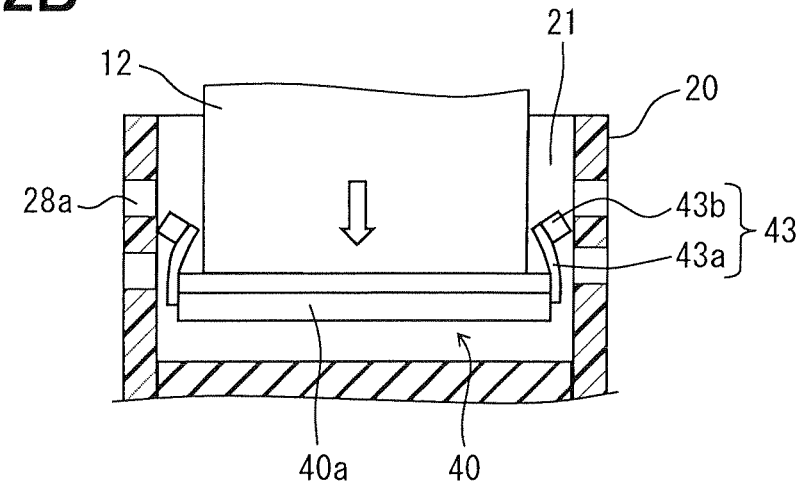
FIG. 12B is a diagram illustrating a cross-sectional view of the card edge connector when the circuit board is brought into contact with the slider during the insertion process, according to the second embodiment.

As the slider body 40*a* is displaced with the circuit board 12, the spring portions 43*a* of the first arms 43 are deflected, that is, resiliently deformed. Thus, as shown in FIG. 12B, the locking portions 43*b* are disengaged from the first through holes 28*a*.

Figure 12C:
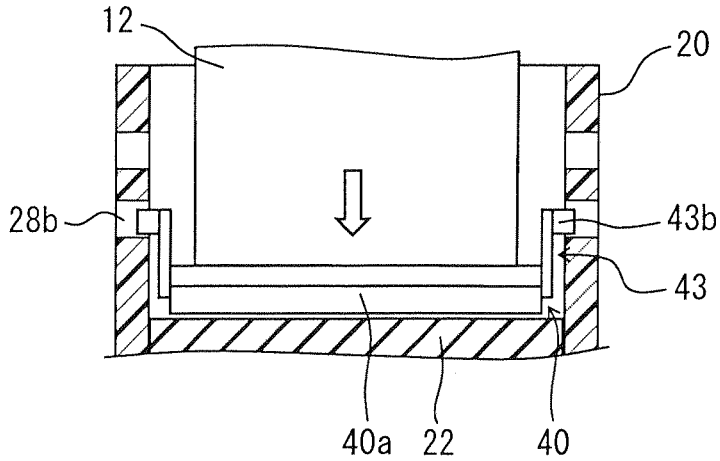
FIG. 12C is a diagram illustrating a cross-sectional view of the card edge connector when the slider is at an insertion completed position, according to the second embodiment.

When the circuit board 12 is further inserted toward the second end of the insertion opening 21, the slider 40 is further pushed by the circuit board 12, and the locking portions 43*b* are received in the second through holes 28*b*, as shown in FIG. 12C. As such, the slider body 40*a* is securely held at the insertion completed position.

Although not illustrated, the slider-contact portions 33 of the terminal projections 32 are completely separated from the slider body 40*a* when the slider 40 is at the insertion completed position. That is, the terminal projections 32 and the slider 40 are in the non-contact state. In such a state, the contacts 31 of the terminal projections 30 are located at the substantially center of the electrodes 60 with respect to the depth direction D1.

As described above, in the present embodiment, the locking portions 43*b* are engaged with the first through holes 28*a* when the slider body 40*a* is at the initial position. That is, the initial position of the slider body 40*a* is fixed by the engagement between the engagement projection and the engagement recess.

In such a case, a deviation of the initial position of the slider body 40*a* is reduced, as compared with the structure where the slider 40 is held at the initial position only by the spring back force of the resiliently deformed terminal projections 32. As such, the reliability in electric connection between the contacts 31 and the electrodes 60 improves.

In the present embodiment, the locking portions 43*b* are engaged with the first through holes 28*a* when the slider body 40*a* is at the initial position. The locking portions 43*b* are engaged with the second through holes 28*b* when the slider body 40*a* is at the insertion completed position.

As described above, the insertion completed position of the slider body 40*a* is fixed by the engagement between the engagement projection and the engagement recess, in addition to the positioning of the slider body 40*a* at the initial position.

Therefore, a deviation in the insertion completed position of the slider body 40*a* is reduced. As such, the reliability in electric connection between the contacts 31 and the electrodes 60 further improves.

In the present embodiment, the engagement recess is provided by the through holes 28 that pass through the side walls 21*b* of the housing 20. Therefore, the engagement recess can be formed at the same time as molding the housing 20 with a resin using a molding die.

In the present embodiment, the water-proof member 22 and the cover 23 serve as a stopper that restricts the slider body 40*a* from being excessively displaced toward the second end of the insertion opening 21 from the insertion completed position.

Therefore, even if the circuit board 12 is excessively or strongly inserted into the insertion opening 21 and the slider 40 cannot be held at the insertion completed position only by the engagement between the engagement projection and the engagement recess, the slider body 40*a* is received by the water-proof member 22 and held at the insertion completed position. Since the stopper is provided by the water-proof member 22 and the cover 23, the number of components can be reduced.

(Modifications)

In the above described example, the engagement projection is formed in the slider 40, and the engagement recess is formed in the housing 20. Alternatively, the engagement recess may be formed in the slider 40, and the engagement projection may be formed in the housing 20.

Figure 13A:
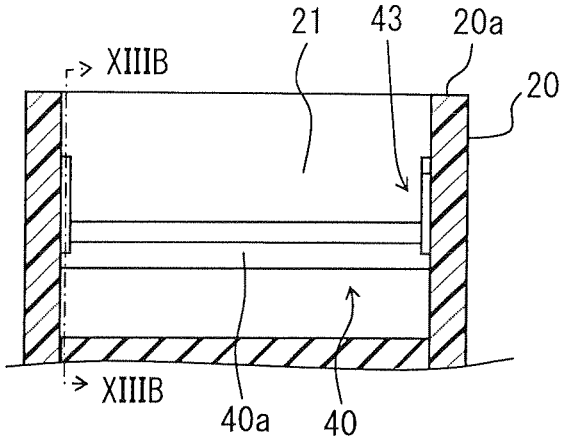
FIG. 13A is a diagram illustrating a cross-sectional view of the card edge connector according to a modification of the second embodiment.
Figure 13B:
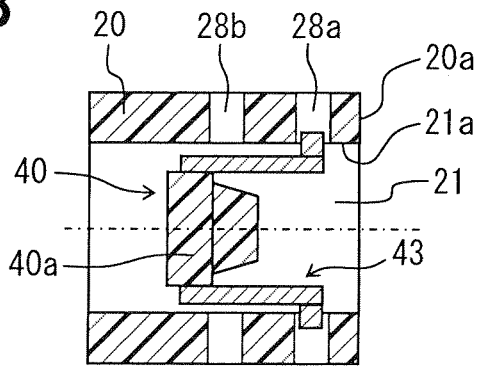
FIG. 13B is a diagram illustrating a cross-sectional view of the card edge connector taken along a line XIIIB-XIIIB in FIG. 13A.

As shown in FIG. 13A and FIG. 13B, the through holes 28 as the engagement recess may be formed in the insertion opening surfaces 21*a* of the housing, which are opposed to each other in the height direction D2. In such a case, the spring portions 43*a* of the first arm 43 are resiliently deformable in the height direction D2.

Figure 14A:
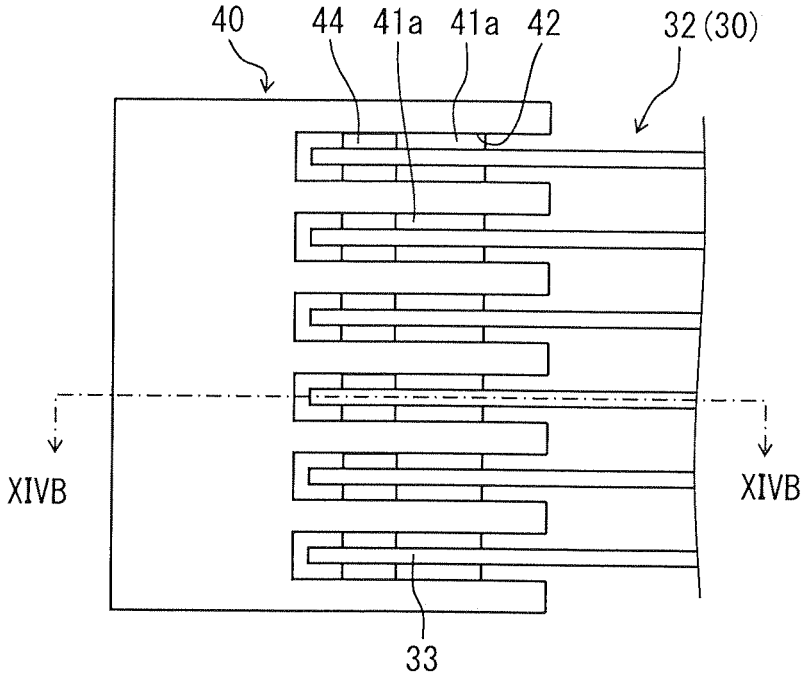
FIG. 14A is a diagram illustrating a plan view of the slider and terminals according to another modification of the second embodiment.
Figure 14B:
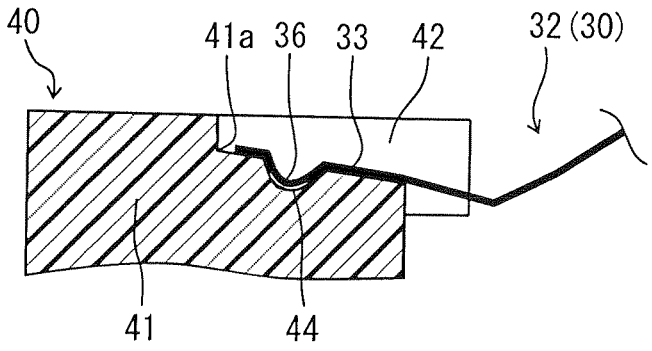
FIG. 14B is a diagram illustrating a cross-sectional view of a part of the slider and the terminal shown in FIG. 14A.

In the above described second embodiment, the slider body 40*a* is fixed to the initial position and the insertion completed position by means of the engagement between the engagement projection and the engagement recess. Alternatively, as shown in FIG. 14A and FIG. 14B, the terminal 30 may have an engagement projection 36 at a part of the slider-contact portion 33, and the slider 40 may have an engagement recess 44 on the support surface 41*a*.

In such a case, as the engagement projection 36 of the terminal 30 is received in the engagement recess 44, at least the initial position of the slider 40 can be fixed at least to the initial position. The illustrations of FIG. 14A and FIG. 14B correspond to illustrations of FIG. 10A and FIG. 10B, respectively.

In the above described second embodiment, the water-proof member 22 has the function of stopper for restricting the slider 40*a* from being excessively displaced from the insertion completed position toward the second end of the insertion opening 21. That is, in such an example, the stopper is provided by a member separate from the housing 20.

Figure 15:
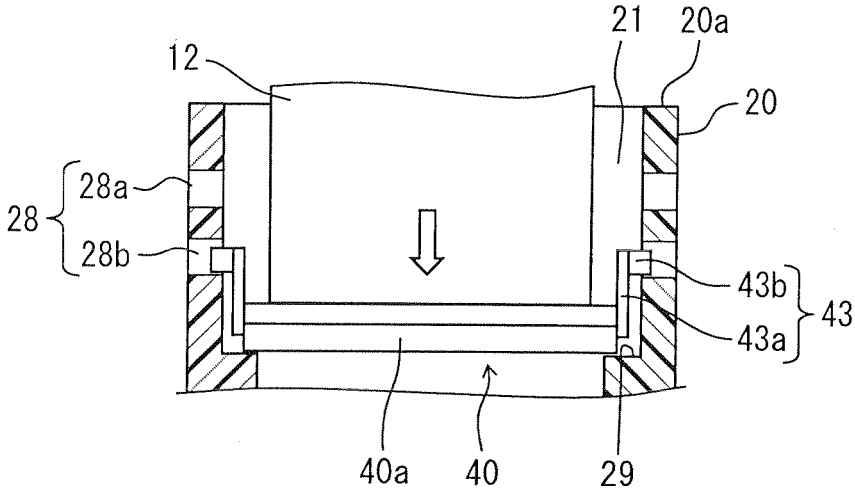
FIG. 15 is a diagram illustrating a cross-sectional view of the card edge connector according to further another modification of the second embodiment.

Alternatively, the stopper may be provided by a part of the housing 20, as shown in FIG. 15. For example, the housing 20 has a stopper 29 at a part of the insertion opening surface 21*a* or the side wall 21*b*. The stopper 29 restricts the slider body 40*a* from being excessively displaced from the insertion completed position toward the second end of the insertion opening 21. In such a case, the number of components can be further reduced.

Figure 16:
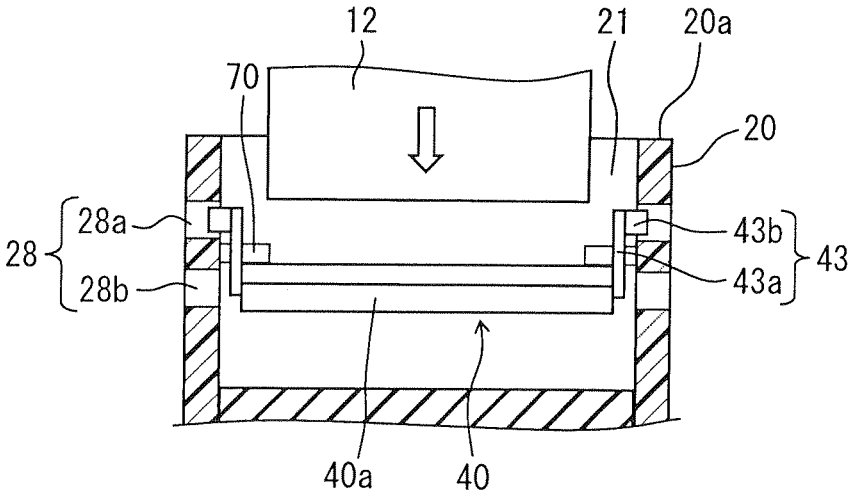
FIG. 16 is a diagram illustrating a cross-sectional view of the card edge connector according to still another modification of the second embodiment.

FIG. 16 illustrates an example where the housing 20 has a stopper 70 that restricts the slider body 40*a* from being displaced from the initial position toward the first end of the insertion opening 21. The stopper 70 is disposed in the insertion opening 21 at a position without interfering with the insertion of the circuit board 12.

For example, even if the slider 40 is excessively or strongly inserted into the insertion opening 21 from the second end and the slider 40 cannot be held at the initial position only by the engagement between the engagement projection and the engagement recess, the slider body 40*a* is received by the stopper 70. Therefore, the slider 40 can be held at the initial position.

In the example shown in FIG. 16, the stopper 70 is provided by a projection projecting from an inner surface of the housing 20 forming the insertion opening 21.

(Third Embodiment)

The electronic device 10 according to a third embodiment has the following structure in addition to the structure according to the second embodiment.

Also in the present embodiment, the slider-contact portion 33 of the terminal projection 32 is inclined so that the distance between the slider-contact portion 33 and the electrode-formed surface of the circuit board 21 with respect to the height direction D2 increases toward the second end of the insertion opening 21.

Although not illustrated, the terminal projection 32 is configured so that the tip end is located further from the electrode-formed surface of the circuit board 21 than the first end of the support surface 41*a* of the slider 40 with respect to the height direction D2 in the state where the terminal projection is completely separated from the slider 40.

In addition to the above structure, the present embodiment employs a slider-returning unit for returning the slider 40 to the initial position with the displacement of the circuit board 12 when the circuit board 12 is removed from the insertion opening 21.

Other structures of the present embodiment are similar to the first embodiment or the second embodiment.

Figure 17:
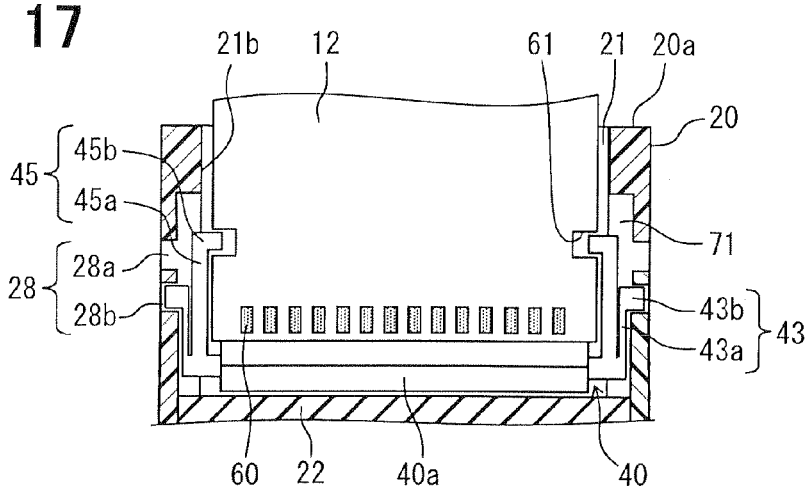
FIG. 17 is a diagram illustrating a cross-sectional view of a card edge connector of an electronic device according to a third embodiment.
Figure 18:
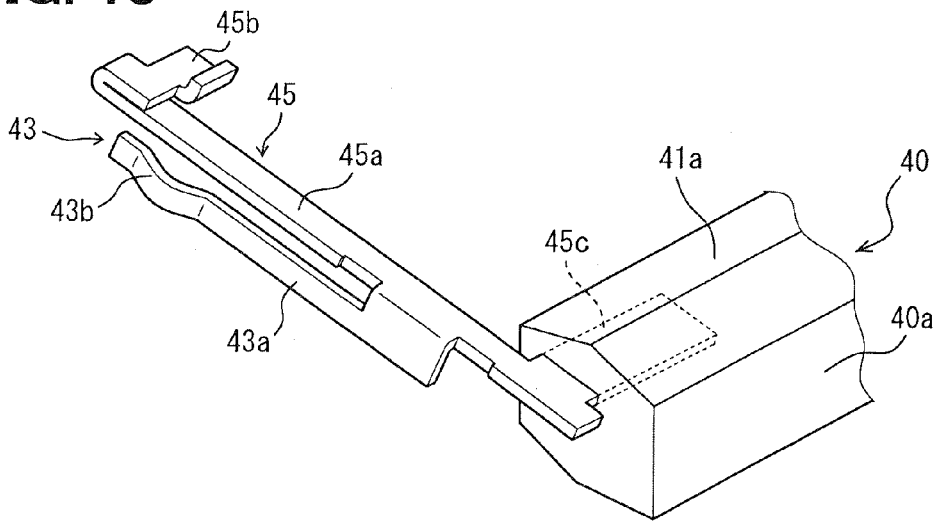
FIG. 18 is a diagram illustrating a perspective view of a slider of the electronic device according to the third embodiment.
Figure 19:
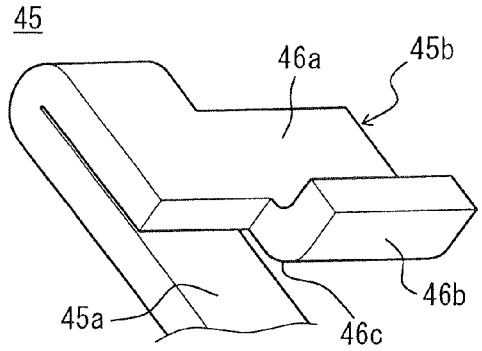
FIG. 19 is a diagram illustrating an enlarged view of a locking portion of the slider shown in FIG. 18.

FIG. 17 through FIG. 19 illustrate a schematic structure of the electronic device 10 according to the present embodiment. FIG. 17 is a diagram for illustrating a positional relationship between the positioning unit and the slider-returning unit.

In FIG. 17, the housing 20 is illustrated in a cross-section taken along a plane passing through the first and second through holes 28 (28*a*, 28*b*) of the positioning unit, and the slider 40 and the circuit board 12 disposed in the insertion opening 21 are illustrated as a plan view for the purpose of clarifying the positional relationship between the positioning unit and the returning unit. Also, the case 13 is not illustrated for convenience.

The electronic device 10 shown in FIG. 17 through FIG. 19 has the above described feature in addition to the electronic device 10 of the second embodiment.

In the present embodiment, the returning unit is provided by notches 61 formed at side edges of the circuit board 12, second arms 45 projecting from the slider body 40*a*, and guide portions 71*a* formed on the side walls 21*b* of the housing 20. The notches 61 are formed at opposite side edges of the circuit board 12 with respect to the transverse direction D3.

The second arms 45 are disposed in the insertion opening 21 (accommodation space 24) with the slider body 40*a*. Each of the second arms 45 has a spring portion 45*a* and a locking portion 45*b*. The spring portion 45*a* extends from the slider body 40*a* toward the first end of the insertion opening 21 at a location without contacting the circuit board 12 with respect to the transverse direction D3. The spring portion 45*a* is resiliently deformable. The locking portion 45*b* extends from the spring portion 45*a* toward the circuit board 12. The locking portion 45*b* is received in the notch 61 when the slider 40 is at the insertion completed position.

For example, the second arm 45 is formed by punching a single metal plate into a predetermined shape, and bending the punched plate. The second arm 45 has a fixing portion 45*c* and is fixed to the slider body 40*a* by inserting the fixing portion 45*c* into a groove formed on an end surface of the slider body 40*a*. The second arm 45 may be fixed to the slider body 40*a* in various ways, such as by press-fitting, bonding, insert-molding or the like.

The spring portion 45*a* extends from the fixing portion 45*c* toward the end surface 20*a* in the depth direction D1. That is, the spring portion 45*a* extends toward the end surface 20*a* at a position without contacting the circuit board 12 with respect to the transverse direction D3.

As shown in FIG. 18, the locking portion 45*b* is disposed at an end of the spring portion 45*a* opposite to the fixing portion 45*c*. The locking portion 45*b* extends from the spring portion 45*a* in the transverse direction D3, that is, toward the circuit board 12.

For example, as shown in FIG. 17, the locking portion 45*b* is disposed in an area outside of the electrodes 60 of the circuit board 12 with respect to the transverse direction D3 so that the locking portion 45*b* does not contact the surface of the electrode 60 when the circuit board 12 is inserted into or removed from the card edge connector 11. That is, an end of the locking portion 45*b* is located closer to the corresponding side wall 21*b* of the housing 20 than an end of the electrode 60 with respect to the transverse direction D3 so as to avoid interfering with the electrode 60 when the circuit board 12 is inserted into or removed from the card edge connector 11.

Further, as shown in FIG. 19, the locking portion 45*b* has a first wall portion 46*a* and a second wall portion 46*b*. As shown in FIG. 20B, the first wall portion 46*a* has an opposing surface 47 that is opposed to an edge surface 12*a* of the circuit board 12 when the circuit board 12 is inserted into the card edge connector 11. The second wall portion 46*b* extends from an end of the first wall portion 46*a* to a direction in which the locking portion 45*b* is displaced with respect to the height direction D2 when the circuit board 12 is removed from the card edge connector 11, the end facing the second end of the insertion opening 21.

For example, the first wall portion 46*a* and the second wall portion 46*b* are substantially perpendicular to each other. In other words, the first wall portion 46*a* and the second wall portion 46*b* have a generally L-shape. Further, the first wall portion 46*a* and the second wall portion 46*b* have a rounded corner 46*c* between them, as shown in FIG. 19.

The guide portion 71*a* is provided by an inner surface of the side wall 21*b* of the housing 20. The guide portion 71*a* is opposed to the spring portion 45*a* with respect to the depth direction D1. The guide portion 71*a* is located closer to the end surface 20*a* than the spring portion 45*a* with respect to the depth direction D1 in the insertion completed state.

The guide portion 71*a* provides an opposed surface that is opposed to the spring portion 45*a* with respect to the depth direction D1. The opposed surface of the guide portion 71*a* is inclined toward the insertion opening surface 21*a* of the insertion opening 21, which faces the surface 12*b* of the circuit board 12, as a function of distance from the second end of the insertion opening 21.

It is to be noted that the surface 12*b* of the circuit board 12 is any one of the surfaces of the circuit board 12, but corresponds to the surface onto which the second arm 45 mount when the circuit board 12 is inserted into or removed from the housing 20.

In the present embodiment, the side wall 21*b* of the housing 20 has a groove 71 on its inner surface. The guide portion 71*a* is provided by a surface of the groove 71 that is located adjacent to the end surface 20*a* and is opposed to the spring portion 45*a* with respect to the depth direction D1. Further, a part of the second arm 45, mainly, the spring portion 45*a*, is located in the groove 71.

In the present embodiment, the electronic device 10 includes the returning unit for returning the slider 40 to the initial position and the positioning unit for positioning the slider 40. That is, the slider 40 includes the second arm 45 as well as the first arm 43. The first arm 43 and the second arm 45 are integral with each other.

For example, as shown in FIG. 18, the spring portion 43*a* of the first arm 43 diverges from a part of the spring portion 45*a* of the second arm 45. The spring portion 43*a* has a protrusion at a part. The locking portion 43*b* is provided by the protrusion.

The spring portion 45*a* of the second arm 45 is disposed so that a thickness direction of the spring portion 45*a* corresponds to the height direction D2. The spring portion 43*a* of the first arm 43 is disposed so that a thickness direction of the spring portion 43*a* corresponds to the transverse direction D3. Here, the thickness direction means a direction in which a wall thickness of each spring portion 43*a*, 45*a* is measured. Thus, the spring portion 45*a* of the second arm 45 is resiliently deformable in the height direction D2, and the spring portion 43*a* of the first arm 43 is resiliently deformable in the transverse direction D3.

Next, operations to insert the circuit board 12 into the card edge connector 11 and to remove the circuit board 12 from the card edge connector 11 will be described with reference to FIG. 20A through FIG. 28D.

FIG. 20A through FIG. 24D are diagrams for illustrating the insertion operation of the circuit board 12, and FIG. 25A through FIG. 28D are diagrams for illustrating the removal operation of the circuit board 12.

Figure 20A:
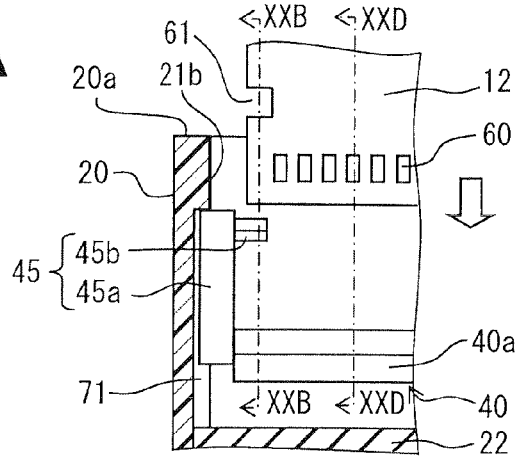
Figure 20B:
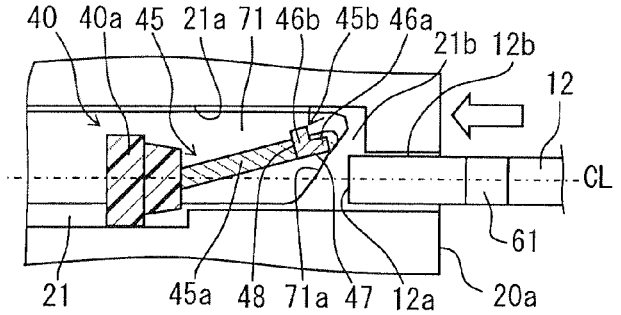
Figure 20C:
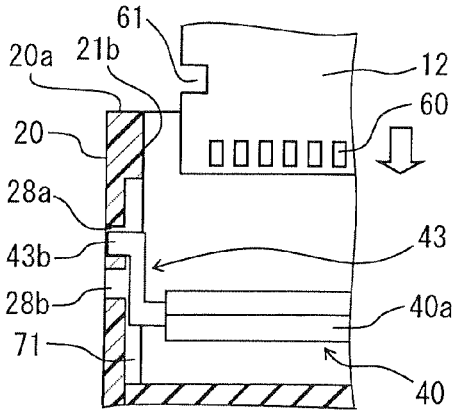
Figure 20D:
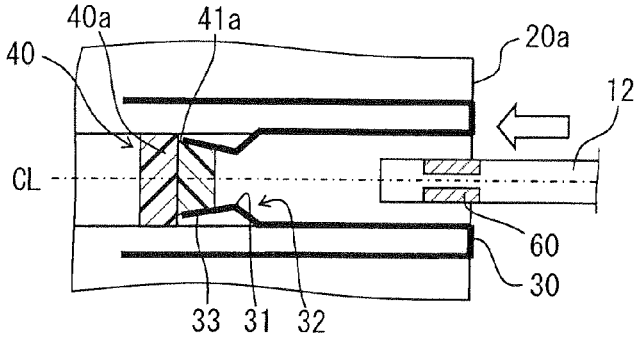
Figure 21A:
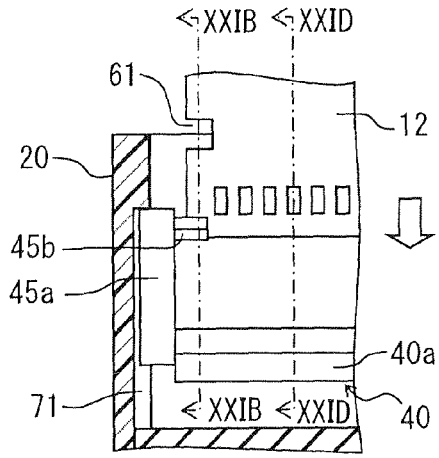
Figure 21B:
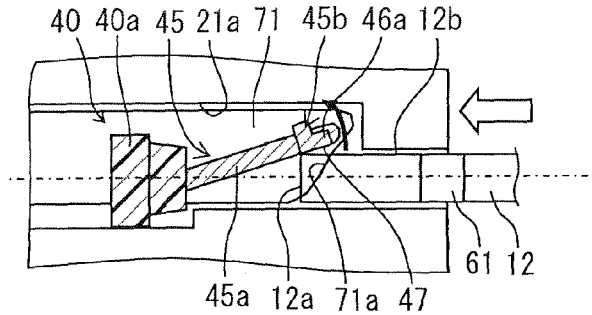
Figure 21C:
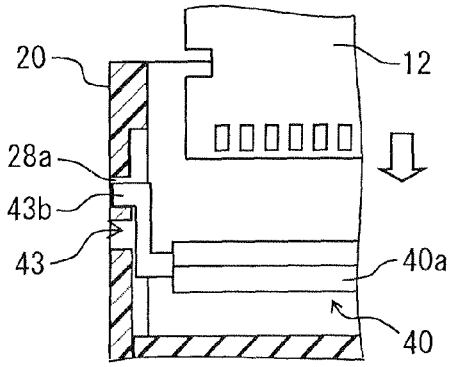
Figure 21D:
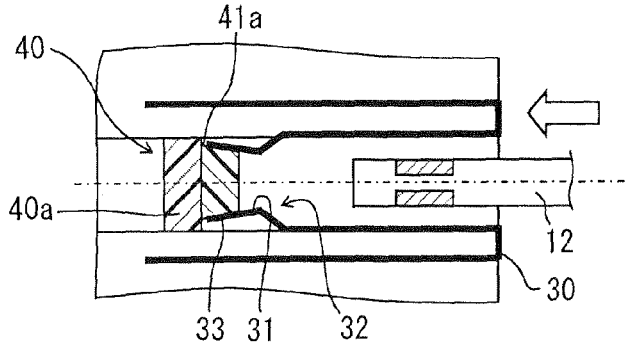
Figure 22A:
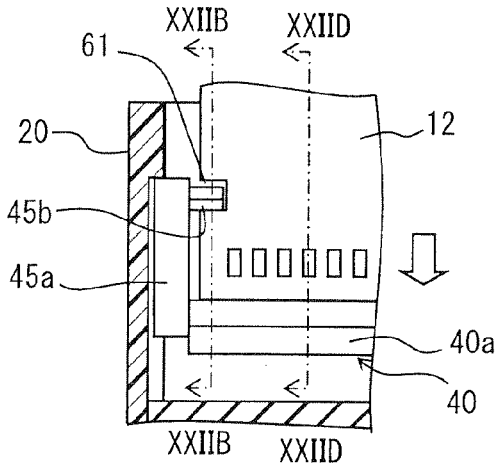
Figure 22B:
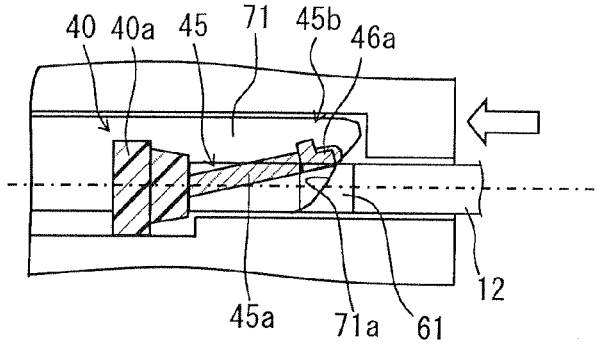
Figure 22C:
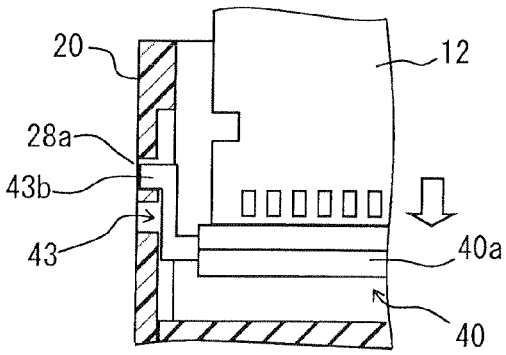
Figure 22D:
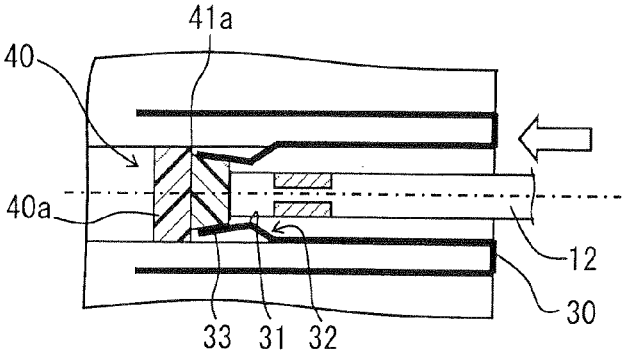

Specifically, FIG. 20A is a diagram for illustrating a cross-section including the returning unit and a view corresponding to FIG. 17. FIG. 20B is a diagram for illustrating a cross-section taken along a line XXB-XXB in FIG. 20A. FIG. 20C is a diagram for illustrating a cross-section including the positioning unit and a view corresponding to FIG. 17. FIG. 20D is a diagram for illustrating a cross-section taken along a line XXD-XXD in FIG. 20A. Also, FIG. 20A through 20D illustrate the same timing in the insertion operation.

FIG. 21A through FIG. 21D, FIG. 22A through FIG. 22D, FIG. 23A through FIG. 23D, and FIG. 24A through FIG. 24D are diagrams respectively corresponding to FIG. 20A through FIG. 20D, but illustrate different timings in the insertion operation. Further, FIG. 25A through FIG. 25D, FIG. 26A through FIG. 26D, FIG. 27A through FIG. 27D, and FIG. 28A through FIG. 28D are diagrams respectively corresponding to FIG. 20A through FIG. 20D, but illustrate respective timings in the removal operation.

FIG. 20A through FIG. 20D illustrate a state before the circuit board 12 contacts the locking portion 45*b* of the second arm 45 during the insertion operation.

In such a state, as shown in FIG. 20D, the terminal projections 32 are expanded since the slider-contact portions 33 are supported on the support surfaces 41*a* of the slider body 40*a*. Thus, the contacts 31 are at positions separated from the corresponding electrode-formed surfaces of the circuit board 12. On the other hand, the slider body 40*a* is in a state of being applied with the spring back force of the terminal projections 32.

As shown in FIG. 20C, the locking portion 43*b* of the first arm 43 is engaged with the first through hole 28*a* of the housing 20. As such, the slider body 40*a* is held at the initial position by the spring back force of the resiliently deformed terminal projections 32 as well as the engagement of the locking portion 43*b* with the first through hole 28*a*.

In the state where the slider body 40*a* is held at the initial position, the second arm 45 is positioned relative to the guide portion 71*a* since the end of the spring portion 45*a* abuts on the guide portion 71*a*. In such a position (e.g., a first guided position), the spring portion 45*a* is held such that a distance between the spring portion 45*a* and the imaginary plane CL with respect to the height direction D2 increases as a function of distance from the slider body 40*a*. Also, the first wall portion 46*a* is held such that a distance between the opposing surface 47 of the first wall portion 46*a* and the imaginary plane CL with respect to the height direction D2 increases as a function of distance from the slider body 40*a*.

The first wall portion 46*a* is inclined with respect to the depth direction D1 so that the opposing surface 47 faces the edge surface 12*a* of the circuit board 12. That is, the opposing surface 47 is inclined to approach the insertion opening surface 21*a* toward the end surface 20*a* with respect to the depth direction D1. Further, the opposing surface 47 is inclined such that an end adjacent to the end surface 20*a* is located higher than the surface 12*b* of the circuit board 12, and an opposite end further from the end surface 20*a* is located lower than the surface 12*b* of the circuit board 12. That is, the opposing surface 47 intersects with a plane including the surface 12*b* of the circuit board 12.

The second wall portion 46*b* of the locking portion 45*b* is disposed such that an opposing surface 48 opposing to the slider body 40*a* is inclined toward the imaginary plane CL as a function of distance from the slider body 40*a*. The opposing surface 48 is inclined relative to the depth direction D1. That is, the opposing surface 48 is inclined such that an end opposite to the first wall portion 46*a* is closer to the slider body 40*a* than an end adjacent to the first wall portion 46*a*. Further, the opposing surface 48 intersects with the plane including the surface 12*b* of the circuit board 12.

FIG. 21A through 21D illustrate a state where the circuit board 12 is in contact with the locking portion 45*b* of the second arm portion 45 and the locking portion 45*b* is mounted on the surface 12*b* of the circuit board 12.

In such a state, because the slider body 40*a* has not been pushed by the circuit board 12 yet, the terminal 30, the slider body 40*a* and the first arm 43 are in the same positions as those in the state shown in FIG. 20A through 20D.

With regard to the locking portion 45*b* of the second arm 45, the opposing surface 47 of the first wall portion 46*a* is inclined relative to the depth direction D1, that is, relative to the surface 12*b* of the circuit board 12. Therefore, the corner of the edge surface 12*a* of the circuit board 12 contacts the opposing surface 47 of the locking portion 45*b*. Because the locking portion 45*b* receives the force in the direction toward the second end of the insertion opening 21 from the circuit board 12, the spring portion 45*a* is pushed in the height direction D2. Thus, the locking portion 45*b* mounts on the surface 12*b* of the circuit board 12.

That is, the end of the spring portion 45*a* and the locking portion 45*b* approach the insertion opening surface 21*a* that faces the surface 12*b* of the circuit board 12. The spring portion 45*a* rotates about the fixing portion 45*c* with the movement of the locking portion 45*b*, and thus the end of the spring portion 45*a* is separated from the guide portion 71*a*.

FIG. 22A through FIG. 22D illustrate a state where the circuit board 12 just contacts the slider body 40*a*, that is, immediately after the circuit board 12 contacts the slider body 40*a*. The state illustrated in FIG. 22A through FIG. 22D also corresponds to a state before the locking portion 45*b* is engaged with the notch 61.

The locking portion 45*b* moves along the surface 12*b* of the circuit board 12 until being received in the notch 61. At a timing where the edge surface 12*a* of the circuit board 12 is brought into contact with the slider body 40*a*, the locking portion 45*b* tries to engage with the notch 61. However, because the end of the spring portion 45*a* abuts on the guide portion 71*a*, the locking portion 45*b* is not entirely received in the notch 61.

FIGS. 23A through 23D illustrate a state where the locking portion 45*b* of the second arm 45 is received in the notch 61 after the circuit board 12 moves toward the second end of the insertion opening 21 while pushing the slider body 40*a*.

When the slider body 40*a* receives the force exceeding the holding force holding the slider body 40*a* at the initial position, that is, when the slider body 40*a* receives the force exceeding the force produced by the spring back force of the resiliently deformed terminal projections 32 as well as the engaging force between the locking portion 43*b* and the first through hole 28*a* from the circuit board 12, the slider body 40*a* is displaced toward the second end of the insertion opening 21 with the circuit board 12.

Figure 23A:
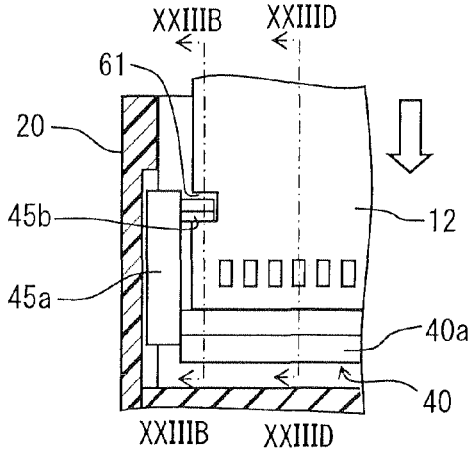
Figure 23B:
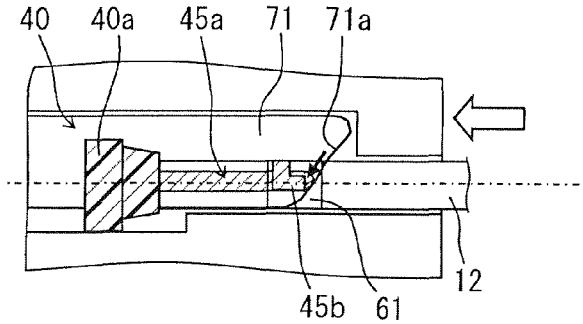
Figure 23C:
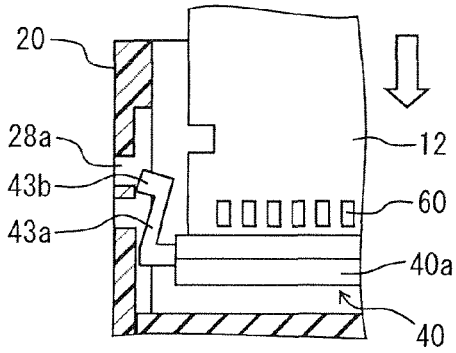
Figure 23D:
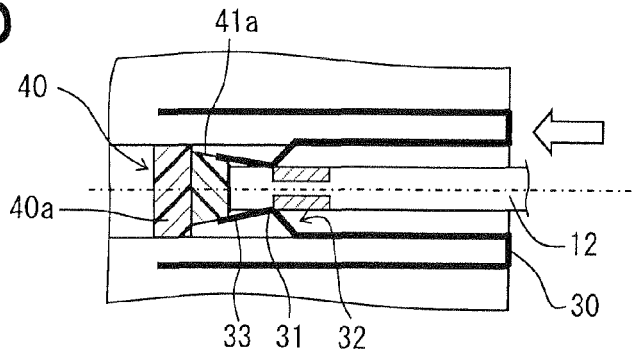

At this time, the first arm 43 and the second arm 45 are displaced with the slider body 40*a* toward the second end of the insertion opening 21. As shown in FIG. 23C, therefore, the spring portion 43*a* is resiliently deformed in the transverse direction D3 and the locking portion 43*b* of the first arm 43 is separated from the first through hole 28*a*. Also, the end of the spring portion 45*a* moves toward the imaginary plane CL along the inclined guide portion 71*a* with the displacement of the slider body 40*a*. As a result, the locking portion 45*b* is received in the notch 61.

In addition, as described in the first embodiment, the force applied to the support surface 41*a* from the slider-contact portion 33 of the terminal projection 32 gradually reduces, and the contact 31 of the terminal projection 32 gradually approaches to the electrode-formed surface of the circuit board 12. In the present embodiment, the contact 31 is brought into contact with the edge of the electrode 60 at the timing where the locking portion 45*b* of the second arm 45 is received in the notch 61.

FIG. 24A through 24D illustrates a state where the insertion of the circuit board 12 is completed.

Figure 24A:
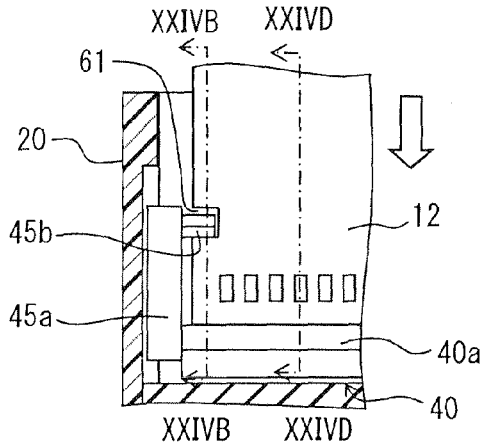
Figure 24B:
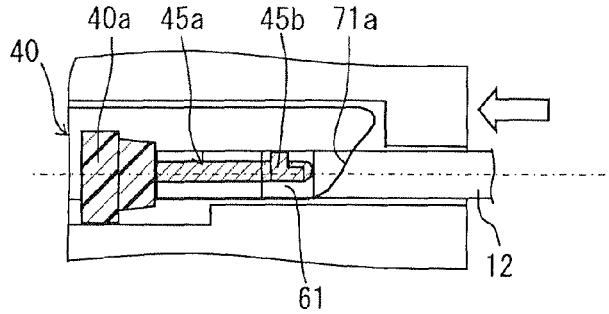
Figure 24C:
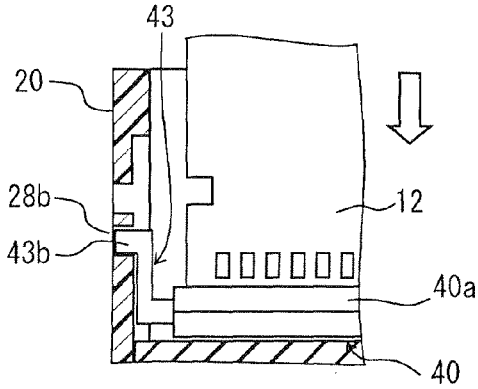

When the circuit board 12 is inserted further from the state shown in FIG. 23A through 23D, the first arm 43 and the second arm 45 are displaced together with the slider body 40*a*. Thus, as shown in FIG. 24C, the locking portion 43*b* is engaged with the second through hole 28*b*. As such, the slider body 40*a* is fixed to the insertion completed position. Further, as shown in FIG. 24B, the end of the spring portion 45*a* is separated from the guide portion 71*a* with the displacement of the slider body 40*a*.

Figure 24D:
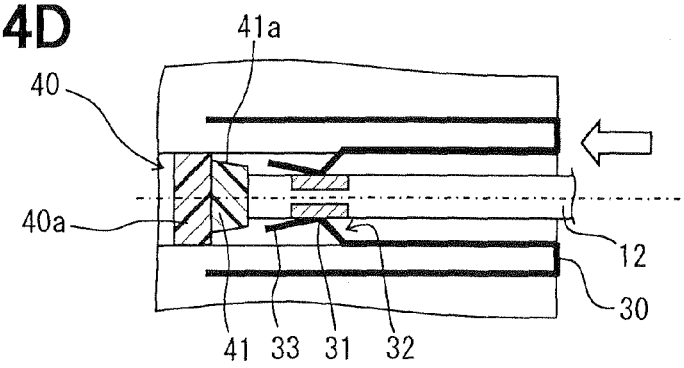

In addition, as shown in FIG. 24D, the slider-contact portion 33 of the terminal 30 is completely separated from the slider 40 with the displacement of the slider body 40*a* toward the second end of the insertion opening 21. At this time, the contact 31 of the terminal 30 wipes the surface of the electrode 60. In a state where the contact 31 is disposed at a substantially center of the electrode 60, the insertion operation is completed.

FIG. 25A through 25D illustrate a state where the end of the spring portion 45*a* of the second arm 45 is brought into contact with the guide portion 71*a*, that is, immediately after the end of the spring portion 45*a* contacts the guide portion 71*a*, in the removable operation.

When the circuit board 12 is pulled from the insertion completed position, the opposing surface 48 of the second wall portion 46*b*, that is, the end surface of the locking portion 45*b* is pushed by the end surface of the notch 61. Thus, the slider body 40*a* is displaced with the circuit board 12 as being tugged by the second arm 45.

Figure 25A:
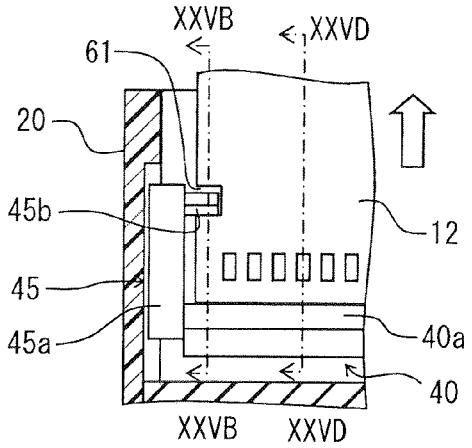
Figure 25B:
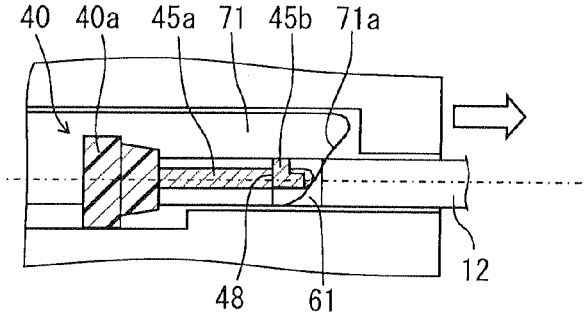

The second arm 45 receives an external force only from the circuit board 12 until the spring portion 45*a* is brought into contact with the guide portion 71*a*. Therefore, as shown in FIG. 25B, the spring portion 45*a* is in a position parallel the depth direction D1 until the spring portion 45*a* abuts on the guide portion 71*a*.

Figure 25C:
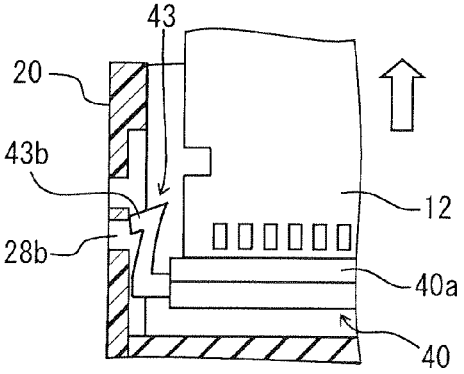

Meanwhile, the first arm 43 moves with the slider body 40*a*. Therefore, as shown in FIG. 25C, the spring portion 43*a* is resiliently deformed in the transverse direction D3 and thus the locking portion 43*b* of the first arm 43 is separated from the second through hole 28*b*.

Figure 25D:
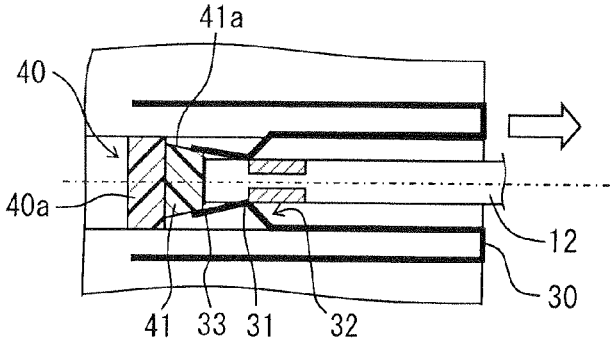

As described above, the slider-contact portions 33 of the terminal 30 have the inclined shape so that the distance between the tip ends of the slider-contact portions 33 opposed to each other in the height direction D2 is greater than the thickness of the first end of the slider body 40*a*. Therefore, as shown in FIG. 25D, the first end of the slider body 40*a* can be placed in between the tip ends of the slider-contact portions 33 when the slider body 40*a* is moved toward the first end of the insertion opening 21.

At this timing, the contacts 31 of the terminals 30 are still in contact with the ends of the electrodes 60 and are in the state immediately before separating from the electrode-formed surfaces of the circuit board 12.

FIG. 26A through FIG. 26D illustrates a state immediately after the locking portion 43*b* of the first arm 43 is received in the first through hole 28*a*, that is, immediately after the slider body 40*a* is disposed at the initial position.

Figure 26A:
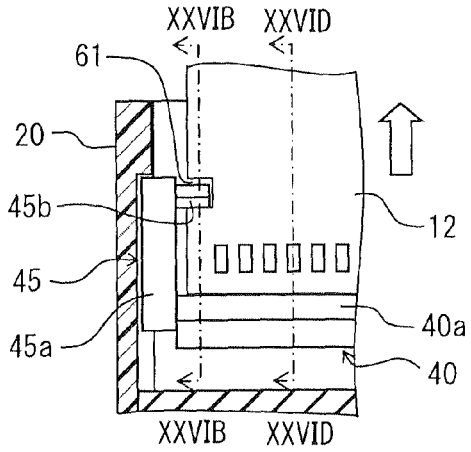
Figure 26B:
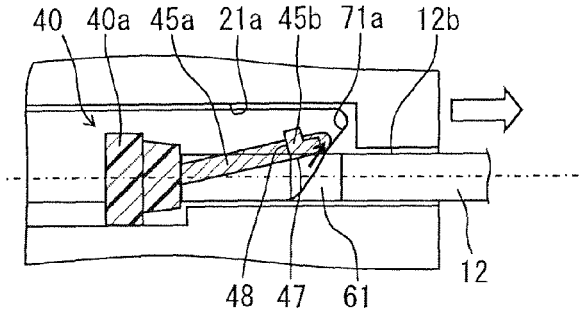
Figure 26C:
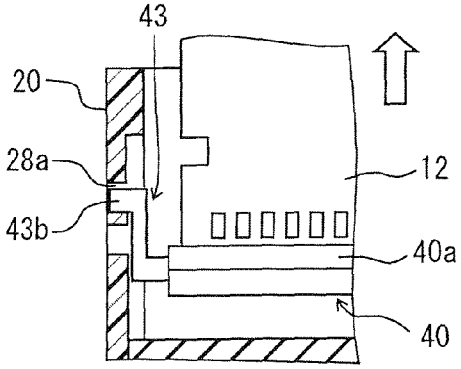

When the circuit board 12 is further pulled from the state where the end of the spring portion 45*a* of the second arm 45 abuts on the guide portion 71*a*, as shown in FIG. 26B, the end of the spring portion 45*a* moves diagonally upward along the inclined guide portion 71*a*, that is, toward the insertion opening surface 21*a* facing the surface 12*b* of the circuit board 12 (e.g., the first guided position). Therefore, the locking portion 45*b* moves in a direction separating from the notch 61.

In the initial state shown in FIG. 26B, the opposing surface 47 of the first wall portion 46*a* is inclined relative to the imaginary plane CL and opposed to the edge surface 12*a* of the circuit board 12. Also, the opposing surface 47 is inclined to intersect with the plane including the surface 12*b* of the circuit board 12.

Figure 26D:
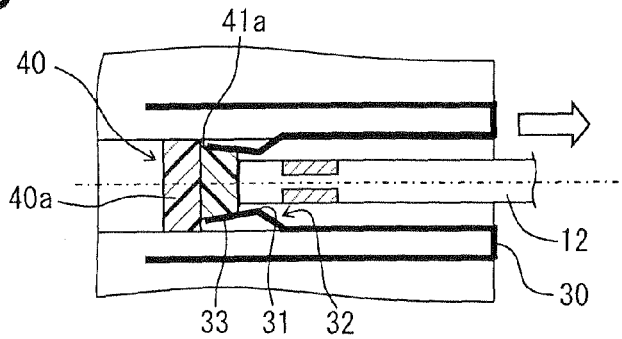
Figure 27A:
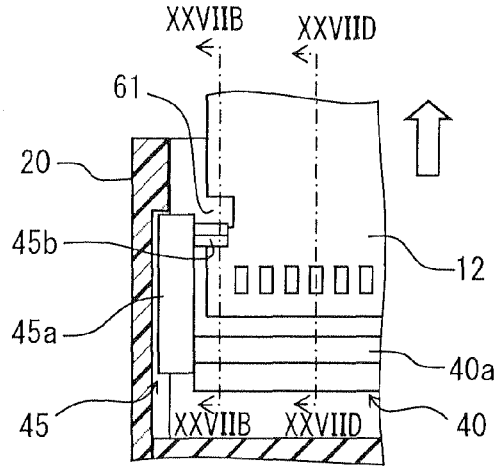
Figure 27B:
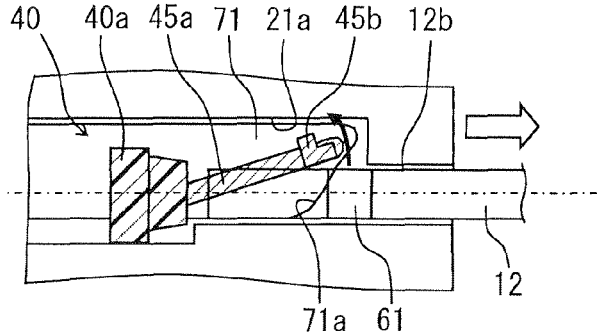
Figure 27C:
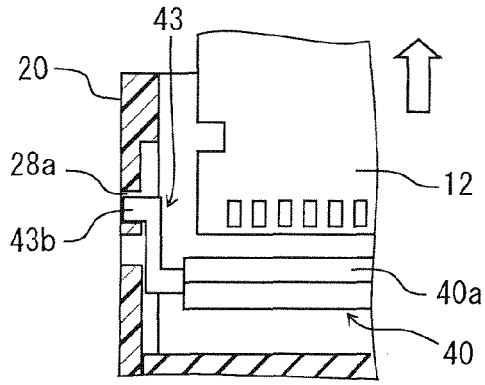
Figure 27D:
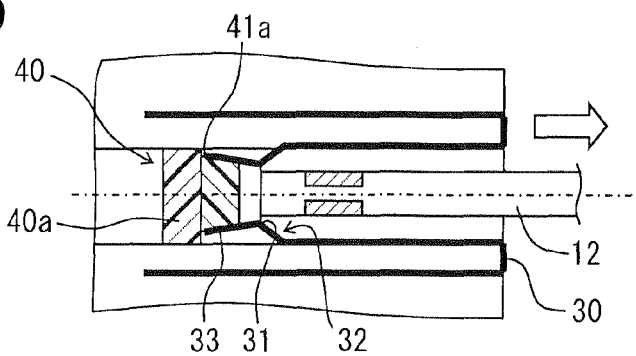

The terminal projections 32 are expanded toward the insertion opening surfaces 21*b* along the support surfaces 41*a* of the slider body 40*a* with the displacement of the slider body 40*a*. In such a state, as shown in FIG. 26D, the entirety of the slider-contact portions 33 are supported on the support surfaces 41*a* of the slider body 40*a*, and the contacts 31 of the terminal projections 32 are separated from the electrode-formed surfaces of the circuit board 12.

FIG. 27A through FIG. 27D illustrate a state where the locking portion 45*b* of the second arm portion 45 is mounted on the surface 12*b* of the circuit board 12.

In the state shown in FIG. 26B, the second wall portion 46*b* of the locking portion 45*b* is disposed such that the opposing surface 48 is inclined to approach the imaginary plane CL as a function of distance from the slider body 40*a*. That is, the opposing surface 48 of the second wall portion 46*b* is inclined relative to the depth direction D1.

Further, the opposing surface 48 is disposed to intersect with the imaginary plane including the surface 12*b* of the circuit board 12. Therefore, when the circuit board 12 is further pulled, the spring portion 45*a* is resiliently deformed in the height direction D2, that is, toward the insertion opening surface 21*a* by the circuit board 12, and the locking portion 45*b* is mounted on the surface 12*b* of the circuit board 12.

At this timing, the slider body 40*a* is at the initial position same as the state shown in FIG. 26A through 26D. The slider body 40*a*, the first arm 43, and the terminal 30 are in the same state as those shown in FIG. 26A through 26D.

FIG. 28A through FIG. 28D illustrate a state where the circuit board 12 has been removed from the card edge connector 11 after passing through the second arm 45.

Figure 28A:
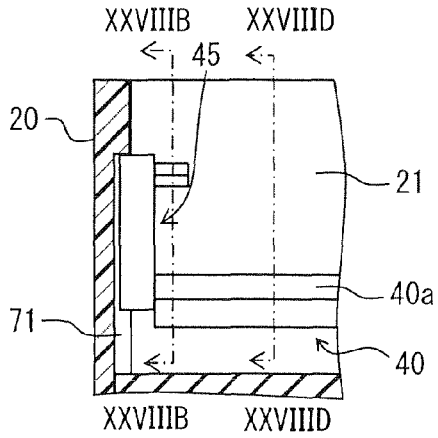
Figure 28B:
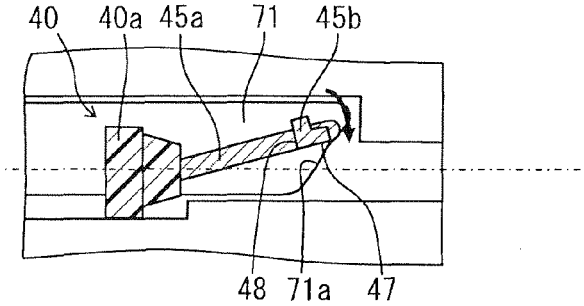
Figure 28C:
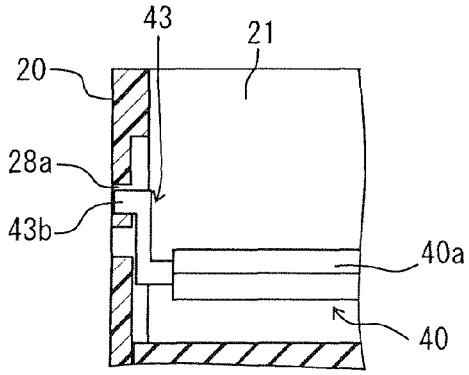
Figure 28D:
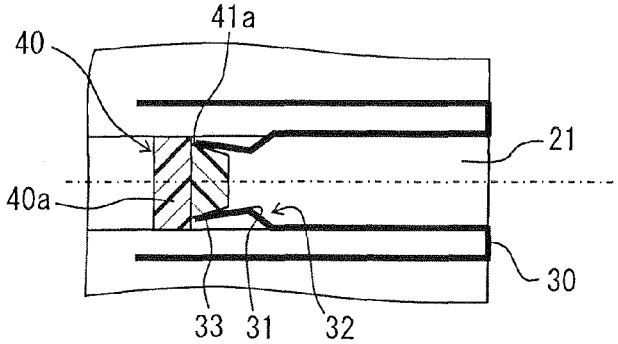

The locking portion 45*b* of the second arm 45 abuts on the surface 12*b* of the circuit board 12 while the circuit board 12 is passing through the locking portion 45*b*. As shown in FIG. 28B, when the circuit board 12 is removed after passing through the locking portion 45*b*, the locking portion 45*b* is no longer supported by the circuit board 12. Thus, the end of the spring portion 45*a* is moved to the guide portion 71*a* as the spring portion 45*a* releases the energy of resiliently deformation. That is, the spring portion 45*a* returns to the position shown in FIG. 20B (e.g., the first guided position).

As described above, in the present embodiment, when the circuit board 12 is removed from the insertion opening 21, the slider 40 can be returned to the initial position with the displacement of the circuit board 12 by the returning unit.

As the slider body 40*a* is pulled with the circuit board 12, the slider-contact portions 33 are supported on the slider body 40*a* and the terminal projections 32 are expanded so that the contacts 31 are separated from the electrode-formed surfaces of the circuit board 12. Therefore, the circuit board 12 can be repetitively inserted into or removed from the card edge connector 11.

In addition, when the circuit board 12 is pulled from the card edge connector 14, the slider-contact portions 33 of the terminals 30 are supported on the support surfaces 41*a* of the slider body 40*a*, and the contacts 31 of the terminals 30 can be separated from the circuit board 12. That is, the contact 31 do not contact with the circuit board 12.

Since it is less likely that the plated layers on the surfaces of the terminals 30 will be peeled off and the terminals 30 will be damaged, the short-circuit due to the peeled materials or the like can be reduced. Accordingly, the reliability in electric connection improves.

(Modifications)

In the above described example, the electronic device 10 has both the returning unit and the positioning unit. However, it is not always necessary that the electronic device 11 has the positioning unit. The positioning unit may be eliminated.

In the above described example, the locking portion 45*b* has the L-shape including the first wall portion 46*a* and the second wall portion 46*b*, as an example.

Figure 29:
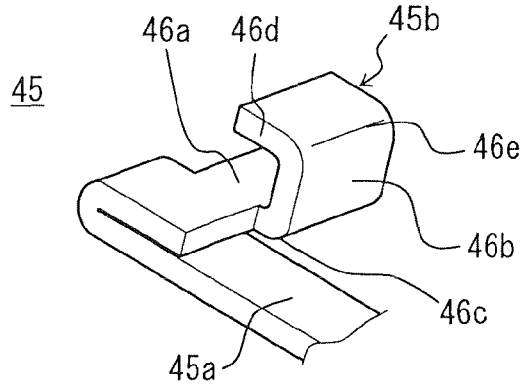
FIG. 29 is a diagram illustrating an enlarged view of the locking portion according to a modification of the third embodiment.

FIG. 29 illustrates another example of the locking portion 45*b*. In the example shown in FIG. 29, the locking portion 45*b* has a third wall portion 46*d*, in addition to the first wall portion 46*a* and the second wall portion 46*b*. The third wall portion 46*d* extends from an end of the second wall portion 46*b* opposite to the first wall portion 46*a*. The third wall portion 46*d* is opposed to the first wall portion 46*a*.

Figure 30A:
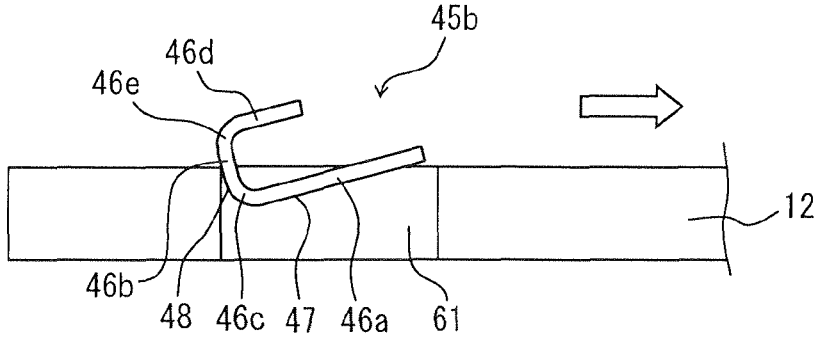
FIG. 30A is a diagram illustrating an explanatory view of the locking portion when removed from a notch of a circuit board according to the modification shown in FIG. 29.
Figure 30B:
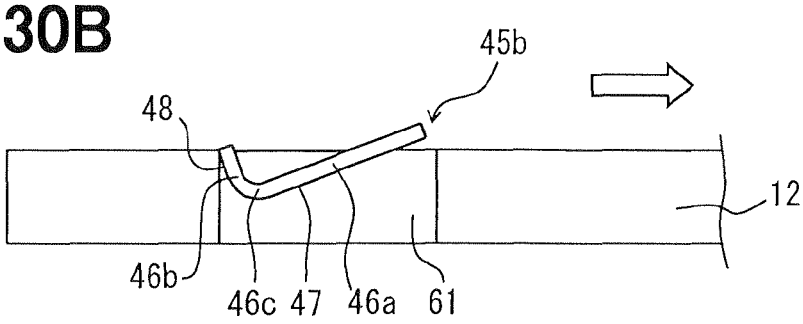
FIG. 30B is a diagram illustrating an explanatory view of the locking portion when removed from the notch of the circuit board as a comparative example.

In the example of the L-shaped locking portion 45*b*, if an end of the second wall portion 46*b* is caught by the wall of the notch 61 when the circuit board 12 is pulled, as shown in FIG. 30B, it may be necessary to apply a force greater than a normal force to separate the locking portion 45*b* from the notch portion 61.

In the example of the U-shaped locking portion 45*b* shown in FIG. 29, the locking portion 45*b* is smoothly separated from the notch 61 when the circuit board 12 is pulled, as shown in FIG. 30A. In a case where the locking portion 45*b* has a rounded corner 46*e* between the second wall portion 46*b* and the third wall portion 46*d*, the locking portion 45*b* is further smoothly separated from the notch 61.

Figure 31A:
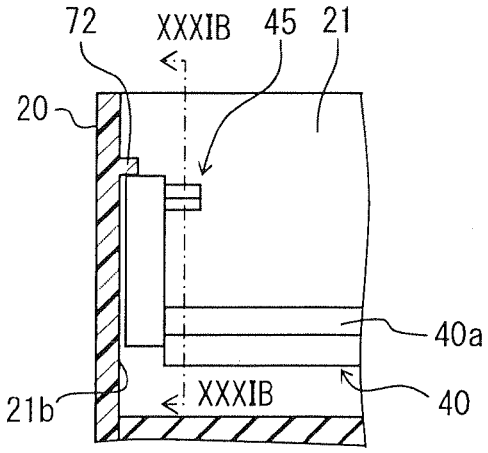
FIG. 31A is a diagram illustrating a cross-sectional view of a part of the card edge connector according to another modification of the third embodiment.
Figure 31B:
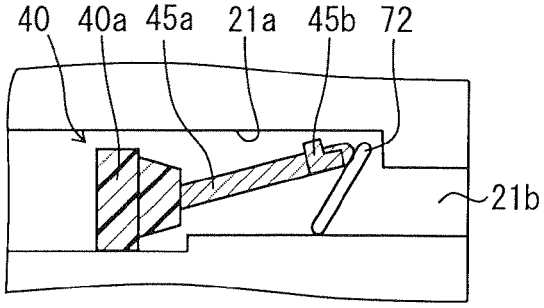
FIG. 31B is a diagram illustrating a cross-sectional view of the card edge connector taken along a line XXXIB-XXXIB in FIG. 31A.

In the above described example, the guide portion 71*a* is exemplarily provided by a part of the wall of the groove portion 71 formed on the side wall 21*b* of the housing 20. Alternatively, the guide portion may be provided by a projection 72 projecting from the inner surface of the side wall 21*b* of the housing 20 in the transverse direction D3, as shown in FIG. 31A and FIG. 31B.

Also in the third embodiment, the support surfaces 41*a* for receiving the slider-contact portions 33 of the terminals 30 are provided by the bottom surfaces of the grooves 42 of the slider body 40*a*, as shown in FIG. 10. In such a case, the walls of the slider body 40*a* forming the grooves restrict the adjacent slider-contact portions 33 from contacting with each other in the transverse direction D3. Thus, it is less likely that the plated layers of the terminals 30 will be peeled off and the terminal 30 will be deformed.

The second arm 45 including the L-shaped locking portion 45*b* can be configured to satisfy the following relationship, for example.

Figure 32:
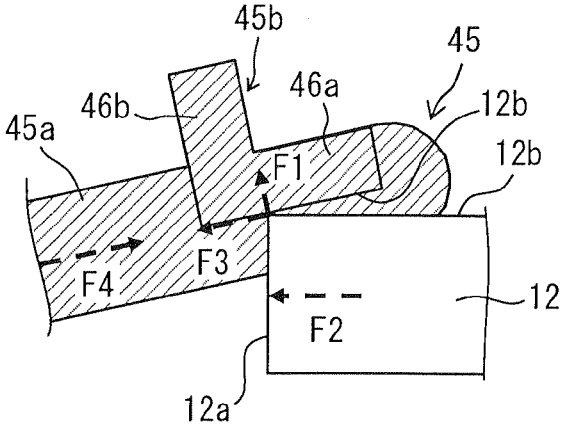
FIG. 32 is a diagram illustrating a relationship between a second arm of the slider and the circuit board according to the third embodiment, in which the second arm is hatched for convenience.

Referring to FIG. 32, F1 denotes a force required to deflect the spring portion 45*a* in the height direction D2, and F2 denotes a force along the depth direction D1 when the circuit board 12 is inserted. F3 denotes a force caused by the force F2 to push the locking portion 45*b* and further the spring portion 45*a*. F4 denotes drag against the force F3, particularly, a force to hold the slider 40 by the first arm 43. In FIG. 32, the second arm 45 is hatched for convenience.

A material, width (cross-sectional area) and length of the second arm 45, and the shape of the locking portion 45*b* are determined so as to satisfy a relationship of F2>F1 and a relationship of F3<F4.

When the relationship of F2>F1 is satisfied, deflection of the spring portion 45*a* is restricted during the insertion of the circuit board 12. Therefore, the locking portion 45*b* can be mounted onto the surface 12*b* of the circuit board 12. Also, the locking portion 43*b* of the first arm 43 can be removed from the first through hole 28*a* by inserting the circuit board 12.

In the above described third embodiment, the second arm 45 includes the locking portion 45*b* having the substantially L-shape including the first wall portion 46*a* and the second wall portion 46*b*. Also, when the slider 40 is at the initial position, the opposing surface 47 of the first wall portion 46*a* is disposed such that the end adjacent to the end surface 20*a* is located higher than the surface 12*b* of the circuit board 12 with respect to the height direction D2 and the opposing surface 47 intersects with the plane including the surface 12*b*.

Figure 33:
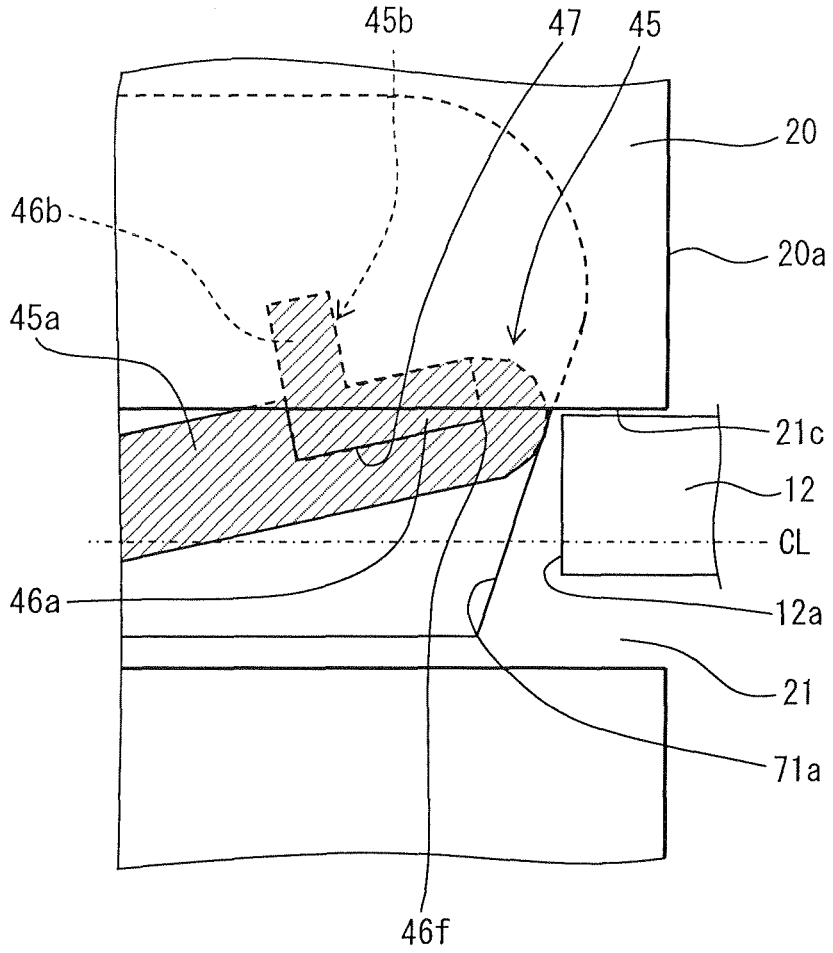
FIG. 33 is a diagram illustrating a relationship between the second arm and the circuit board as a comparative example, in which the second arm is hatched for convenience.

FIG. 33 illustrates an explanatory example where an end 46*f* of the first wall portion 46*a* is located closer to the imaginary plane CL than a portion 21*c* of the insertion opening 21, the portion (insertion opening surface) 21*c* is a part of the insertion opening surface 21*a* and is closest to the imaginary plane CL within the insertion opening surface 21*a* with respect to the height direction D2.

As shown in FIG. 33, if the center of the circuit board 12 is displaced from the imaginary plane CL when the circuit board 12 is inserted into the insertion opening 21, the edge surface 12*a* of the circuit board 12 contacts the end 46*f* of the first wall portion 46*a*.

With the insertion of the circuit board 12, if the spring portion 45*a* is pushed in the depth direction D1 without deflecting in the height direction D2, the terminals 30 may be separated from the slider 40 before the circuit board 12 reaches the predetermined position.

Figure 34:
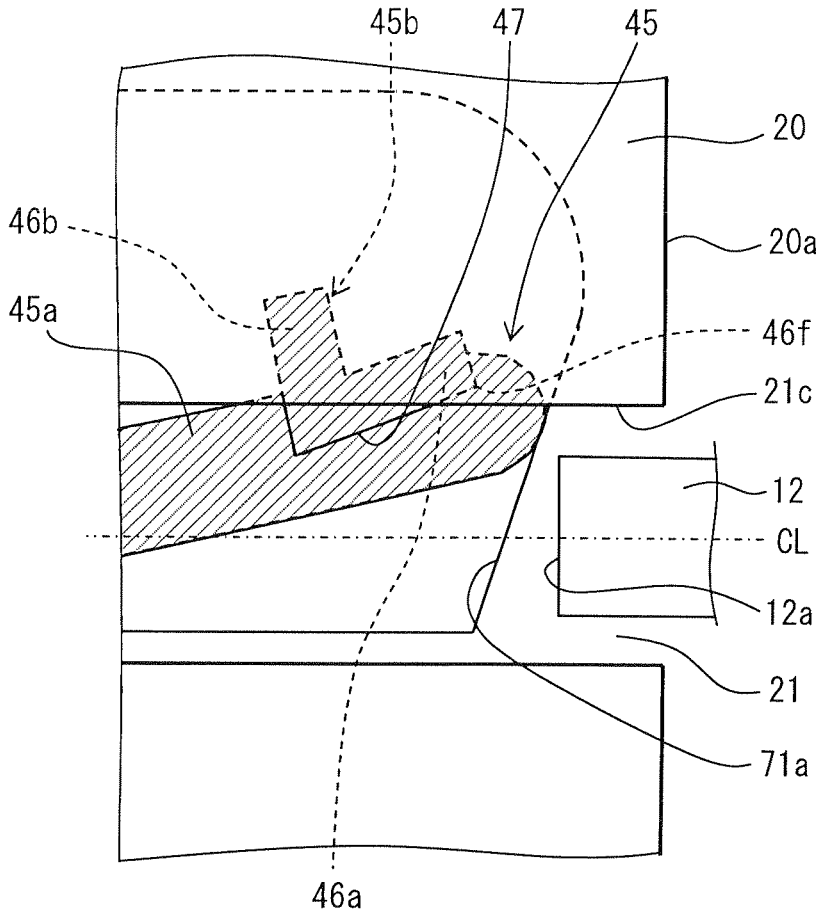
FIG. 34 is a diagram illustrating another example of the locking portion, in which the second arm is hatched for convenience, according to the third embodiment.

Therefore, in an example shown in FIG. 34, the first wall portion 46*a* of the locking portion 45*b* can be configured so that the opposing surface 47 intersects with a plane including the insertion opening surface 21*c* when the slider 40 is at the initial position. In other words, the end 46*f* of the first wall portion 46*a* is located further from the imaginary plane CL than the insertion opening surface 21*c*.

In the example shown in FIG. 34, the insertion opening surface 21*c* is provided by the portion of the insertion opening surface 21*a* disposed between the terminals 30 with respect to the transverse direction D3, in a predetermined depth from the end surface 20*a* of the housing 20, as shown in FIG. 2 and FIG. 11A.

In such a case, even if the center of the circuit board 12 is deviated from the imaginary plane CL when the circuit board 12 is inserted into the insertion opening 21, the edge surface 12*a* of the circuit board 12 always contacts the opposing surface 47 of the first wall portion 46*a*. As such, even if the position of the circuit board 12 is deviated with respect to the height direction D2, the slider 40 can exert its function properly.

In the example shown in FIG. 34, further, the first wall portion 46*a* and the second wall portion 46*b* form an acute angle between them. In such a structure, the size of the locking portion 45*b* in the depth direction D1 can be reduced, as compared with the structure where the first wall portion 46*a* and the second wall portion 46*b* are perpendicular to each other. As such, the notch 61 of the circuit board 12 to which the locking portion 45*b* is engaged, that is, a mounting restriction area of the circuit board 12 can be reduced in size.

Figure 35:
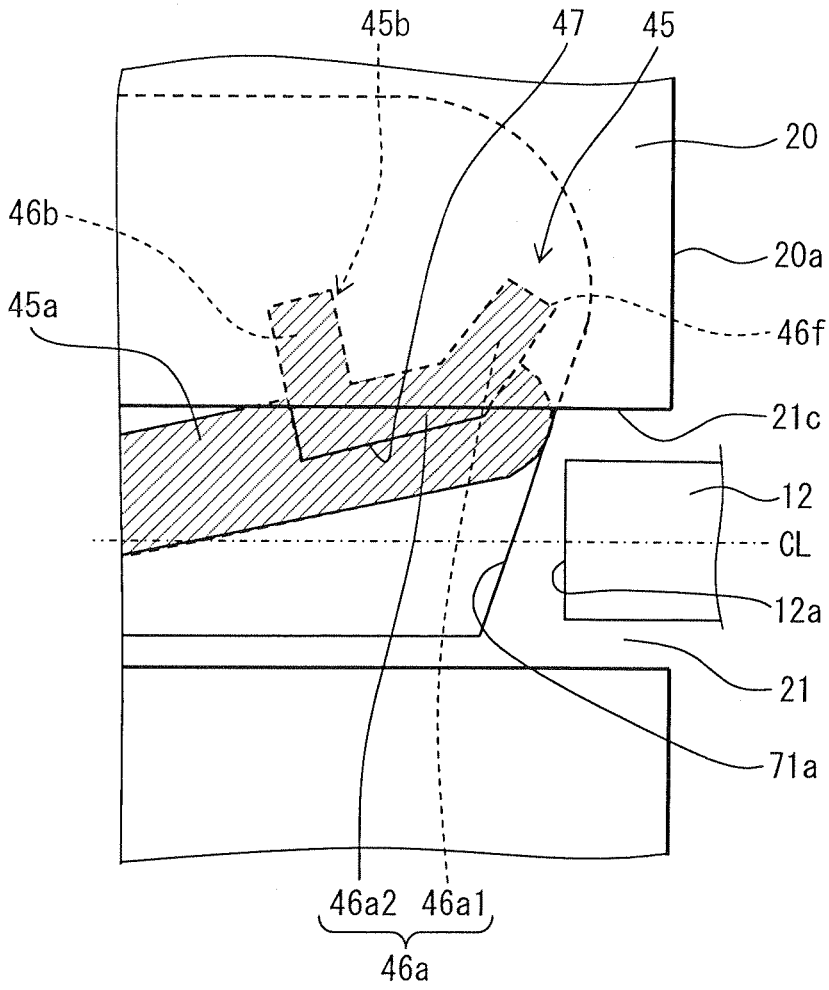
FIG. 35 is a diagram illustrating further another example of the locking portion, in which the second arm is hatched for convenience, according to the third embodiment.

FIG. 35 illustrates an example that reduces the size of the locking portion 45*b* in the depth direction D1. In the example shown in FIG. 35, the first wall portion 46*a* is angled to include a front portion (first section) 46*a*1 adjacent to the end surface 20*a* and a rear portion (second section) 46*a*2 further from the end surface 20*a* than the front portion 46*a*1.

An angle defined between the front portion 46*a*1 and the second wall portion 46*b* is smaller than an angle defined between the rear portion 46*a*2 and the second wall portion 46*b*. For example, the angle defined between the rear portion 46*a*2 and the second wall portion 46*b* is substantially a right angle, and the angle defined between the front portion 46*a*1 and the second wall portion 46*b* is an acute angle.

In such a structure, the size of the locking portion 45*b* with respect to the depth direction D1 can be reduced, as compared with the structure where the first wall portion 46*a* and the second wall portion 46*b* are perpendicular to each other.

Since the first wall portion 46*a* is angled, the size of the locking portion 45*b* with respect to the depth direction D1 can be reduced, as compared with the straight first wall portion 46*a*. As such, the size of the notch 61 of the circuit board 12, that is, the mounting restriction area of the circuit board 12 can be reduced.

Figure 36:
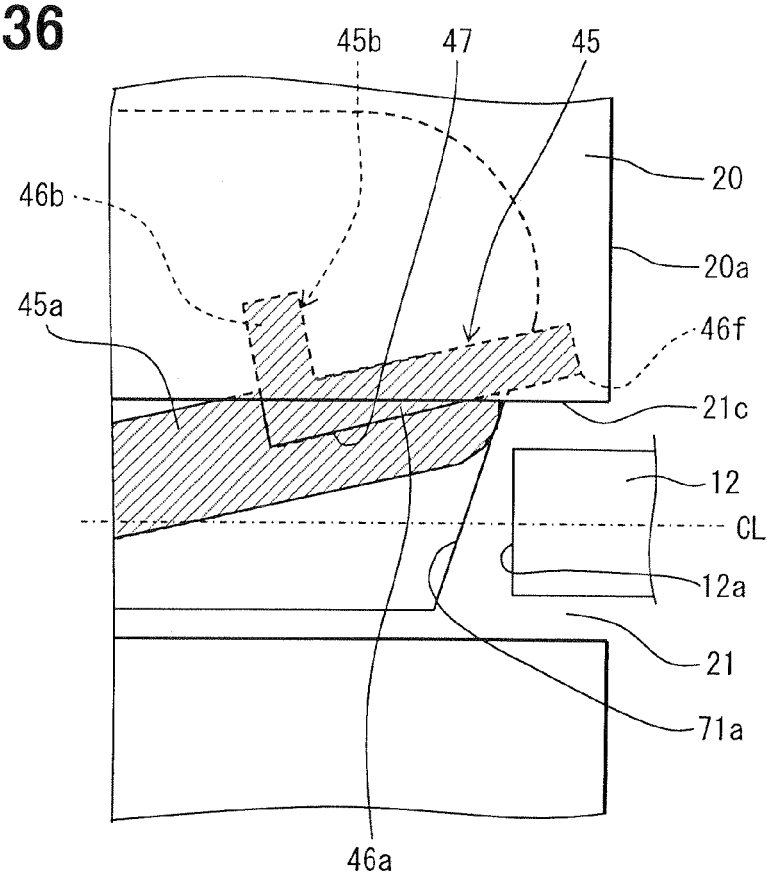
FIG. 36 is a diagram illustrating still another example of the locking portion, in which the second arm is hatched for convenience, according to the third embodiment.

FIG. 36 illustrates another example of the locking portion 45*b*. In the example of FIG. 36, the first wall portion 46*a* is elongated so that the opposing surface 47 intersects with the insertion opening surface 21*c* when the slider 40 is at the initial position.

In the above described example shown in FIG. 18 and FIG. 19, the second arm 45 is formed by bending a crank-shaped metal plate. That is, the locking portion 45*b* is formed by bending the end of the crank-shaped metal plate, and the spring portion 45*a* and the locking portion 45*b* are integral. However, the structure of the second arm 45 is not limited to the above described structure.

Figure 37A:
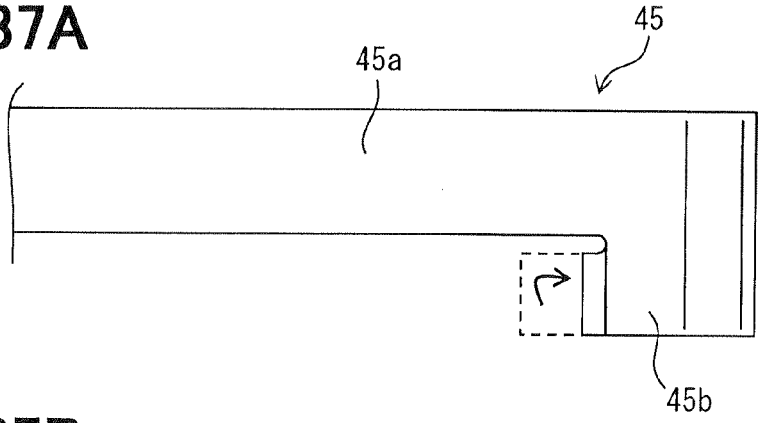
FIG. 37A is a diagram illustrating a plan view of another example of the second arm according to the third embodiment.

As shown in FIG. 37A, for example, the second arm 45 may be formed using a substantially J-shaped metal plate. That is, the locking portion 45*b* is formed by bending the end of the substantially J-shaped metal plate into a substantially L-shape.

Figure 37B:
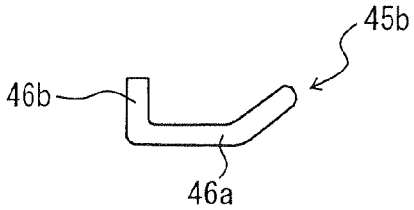
FIG. 37B is a diagram illustrating a side view of the locking portion shown in FIG. 35.

In the example of FIG. 37B, the end of the J-shaped metal plate is formed into the shape of the locking portion 45*b* shown in FIG. 35.

In the above described example, the spring portion 45*a* of the second arm 45 is disposed at the position without overlapping with the circuit board 12 with respect to the transverse direction D3, and the guide portion 71*a* is provided by the surface of the groove portion 71 formed on the side wall 21*b* of the housing 20. However, the returning unit is not limited to the above described structure.

Figure 38:
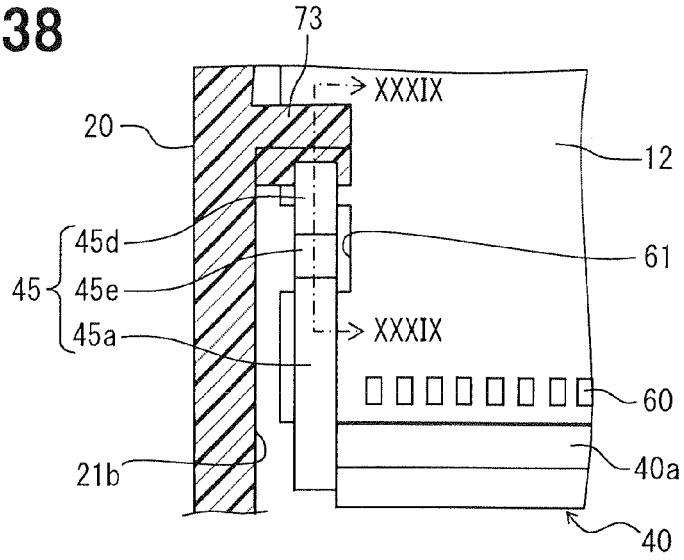
FIG. 38 is a diagram illustrating a cross-sectional view of a part of the card edge connector according to further another modification of the third embodiment.

FIG. 38 illustrates another example of the returning unit. In the example of FIG. 38, the second arm 45 is disposed to extend from the slider body 40*a* toward the end surface 20*a* of the housing 20 at the position corresponding to the notch 61 of the circuit board 12 with respect to the transverse direction D3. Thus, the second arm 45 is located on the circuit board 12.

The second arm 45 shown in FIG. 38 includes the spring portion 45*a*, a locking portion 45*e* and an end portion 45*d*. The spring portion 45*a* is resiliently deformable with respect to the height direction D2, and is located on the surface 12*b* when the slider body 40*a* is at the insertion completed position.

The end portion 45*d* is provided by a predetermined area at the tip end of the second arm 45. The end portion 45*d* has an inclined shape that approaches the insertion opening surface 21*a* that is opposed to the surface 12*b* of the circuit board 12 as a function of distance from the spring portion 45*a*.

The locking portion 45*e* is disposed between the end portion 45*d* and the spring portion 45*a*. The locking portion 45*e* extends from the spring portion 45*a* toward the circuit board 12, and is received in the notch 61 when the slider body 40*a* is at the insertion completed position.

Figure 39:
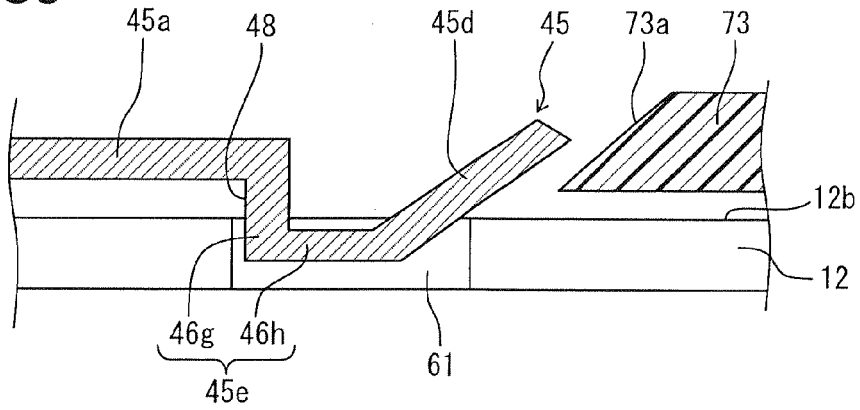
FIG. 39 is a diagram illustrating a cross-sectional view taken along a line XXXIX-XXXIX in FIG. 38.
Figure 40:
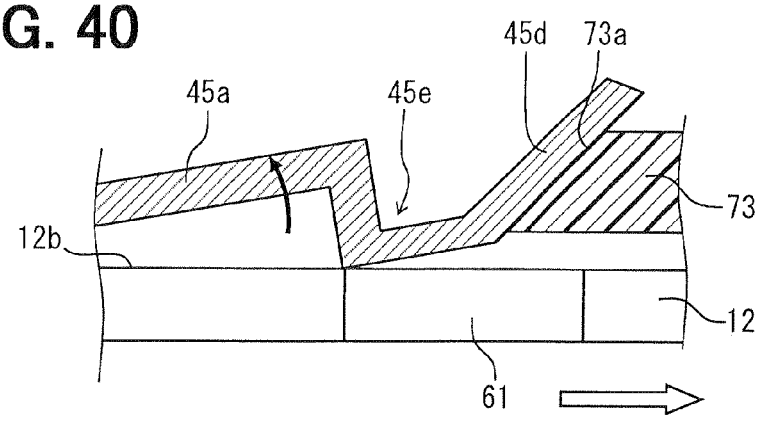
FIG. 40 is a diagram illustrating a cross-sectional view corresponding to the cross-sectional view of FIG. 39 when the circuit board is pulled from a state shown in FIG. 39.

In the example shown in FIG. 38 through FIG. 40, the spring portion 45*a* is disposed such that the thickness direction of the wall of the spring portion 45*a* corresponds to the height direction D2, and a longitudinal direction of the spring portion 45 corresponds to the depth direction D1.

The locking portion 45*e* includes a vertical wall 46*g* and a horizontal wall 46*h*. The vertical wall extends from the spring portion 45*a* and is substantially perpendicular to the spring portion 45*a*. The horizontal wall 46*h* extends from the vertical wall 46*g* and is substantially perpendicular to the vertical wall 46*g*. The end portion 45*d* extends from the horizontal wall 46*h* and forms an obtuse angle with the horizontal wall 46*h*.

A guide portion 73 is provided as a part of the housing 20. The guide portion 73 projects from the inner surface of the side wall 21*b* into the insertion opening 21. The guide portion 73 overlaps with the surface 12*b* of the circuit board 12. Further, the guide portion 73 is disposed adjacent to the end surface 20 than the second arm 45 with respect to the depth direction D1, at a position corresponding to the notch 61 of the circuit board 12 with respect to the transverse direction D3.

The guide portion 73 has an opposing surface 73*a* that is opposed to the end portion 45*d*. The opposing surface 73*a* is inclined so that a distance between the opposing surface 73*a* and the surface 12*b* of the circuit board 12 increases toward the end surface 20*a* with respect to the depth direction D1.

As shown in FIG. 39, a part of the end portion 45*d* is opposed to the opposing surface 73*a* of the guide portion 73 when the slider body 40*a* is at the insertion completed position. When the circuit board 12 is pulled from that position, the vertical wall 46*g* of the locking portion 45*e* is pushed by the surface of the notch portion 61 in the depth direction D1. As such, the slider body 40*a* moves with the circuit board 12 in the depth direction D1.

When the circuit board 12 is further pulled in a state where the end portion 45*d* is in contact with the opposing surface 73*a*, the spring portion 45*a* is deflected in the height direction D2 and the end portion 45*d* approaches the insertion opening surface 21*a* along the tapered guide portion 73. As a result, the locking portion 45*e* is removed from the notch 61 and mounted on the surface 12*b* of the circuit board 12.

In a state where the circuit board 12 is completely removed from the housing 20, the end portion 45*d* is urged against the guide portion 73 due to the spring back force of the spring portion 45*a* and is thus held in the housing 20. The returning unit can be provided by the above described structure including the second arm 45, the guide portion 73 and the notch portion 61. In such a case, the notch 61 is not limited to the opening that opens at the side surface of the circuit board 12. Instead of the notch 61, a through hole may be employed.

The corner of the locking portion 45*e* defined between the vertical wall 46*g* and the horizontal wall 46*h* is in contact with the surface 12*b* of the circuit board 12 while the circuit board 12 passes through the locking portion 45*e*. After the circuit board 12 passed through the locking portion 45*e*, the locking portion 45*e* is no more supported by the circuit board 12 and the spring portion 45*a* releases the energy produced by the resilient deformation. Thus, the end portion 45*d* is urged toward the guide portion 73 in a state where the corner of the locking portion 45*e* is slightly lowered with respect to the height direction D2, and is held by the housing 20.

In such a holding state, the lower surface of the end portion 45*d* or the horizontal portion 46*h* is inclined to approach the insertion opening surface 12*b* toward the end surface 20*a*. Therefore, when the circuit board 12 is inserted, the edge surface 12*a* of the circuit board 12 contacts the lower surface of the end portion 45*d* or the horizontal portion 46*h*. With this, the spring portion 45*a* is bent upward and the corner of the locking portion 45*e* slides along the surface 12*b* of the circuit board 12.

In the above described embodiment, the returning unit is provided by the second arm 45 of the slider 40, the guide portion 71*a*, 73 of the housing 20 and the notch portion 61 of the circuit board 12. However, the returning unit is not limited to the above described structure.

For example, the returning unit may be provided by a resiliently deformable projection formed as a part of the water-proof member 22, a spring disposed between the water-proof member 22 and the slider body 40*a*, and the like.

In such a case, the slider body 40*a* is held at the initial position by the first arm 43 before the edge surface 12*a* of the circuit board 12 is brought into contact with the slider body 40*a*. When the slider body 40*a* is pushed by the circuit board 12, the member of the returning unit such as the spring is resiliently deformed with the movement of the slider body 40*a*. The slider body 40*a* is held at the insertion completed position by the first arm 43 in the state where the member of the returning unit is resiliently deformed.

When the circuit board 12 is pulled, the member of the returning unit releases the spring back force from the resiliently deformed condition. Thus, when the slider body 40*a* is returned to the initial position, the returning member is in a free condition where the spring back force is completely released or a predetermined spring back force is retained to hold at the first arm 43.

The exemplary embodiments and modifications thereof are described hereinabove. However, the present invention is not limited to the above described exemplary embodiments and modifications, but may be implemented in various other ways without departing from the spirit of the invention.

In the above described embodiments and modifications, the circuit board 12 has the electrodes 60 on both surfaces thereof, as well as the slider 40 (slider body 40*a*) has inclined surfaces 41*a* on opposite sides thereof with respect to the height direction D2.

Alternatively, the present invention may be adaptable to the electronic device 10 where the electrodes 60 are formed on only one surface of the circuit board 12, and the inclined support surface 41*a* is formed on only one side of the slider 40 (slider body 40*a*) corresponding to the electrodes 60.

In such a case, the circuit board 12 may be fixed by supporting the surface of the circuit board 12 where the electrodes 60 are not formed a support portion integrally formed in the housing 20. The position of the slider 40 may be fixed in the similar manner.

In some of the above described embodiments and modifications, the terminals 30 are disposed in multiple rows (e.g., two rows in the example of FIG. 2) on the surface 12*b* of the circuit board 12, and the electrodes 60 are formed in multiple rows (e.g., two rows) and staggered in the transverse direction D3, as shown in FIGS. 5A and 5B. However, the arrangements of the terminals 30 and the electrodes 60 are not limited to the above described example.

For example, the terminals 30 may be disposed in multiple rows, but the electrodes 60 may be disposed in one row by reducing the pitch of the electrodes.

Additional advantages and modifications will readily occur to those skilled in the art. The invention in its broader term is therefore not limited to the specific details, representative apparatus, and illustrative examples shown

What is claimed is:

1. An electronic device comprising:

a circuit board that has an electrode-formed surface on which a plurality of electrodes are formed at least on one side of an edge portion of the circuit board; and a card edge connector that provides electric connection with the circuit board, the card edge connector including:

a housing defining an insertion opening for receiving the edge portion of the circuit board, the insertion opening having a first end that opens on an end surface of the housing and a second end opposite to the first end, the insertion opening extending in the housing in a first direction, the housing having insertion opening surfaces that are opposed to each other in a second direction perpendicular to the first direction and defines the insertion opening therebetween;

a plurality of terminals including housing-fixed portions fixed in the housing and terminal projections extending from the housing-fixed portions and projecting into the insertion opening from at least one of the insertion opening surfaces, which faces the electrode-formed surface of the circuit board, toward the second end of the insertion opening, the terminal projections being arranged in the insertion opening in a third direction perpendicular to the first direction and the second direction, the terminal projections being resiliently deformable and including contacts to be in contact with the electrodes of the circuit board; and a slider disposed in the insertion opening between the contacts of the terminal projections and the second end of the insertion opening with respect to the first direction, wherein each of the terminal projections includes a slider-contact portion between the contact and a tip end of the terminal projection, the slider is movable from an initial position before the circuit board is inserted into the insertion opening from the first end to an insertion completed position where an insertion of the circuit board is completed when the circuit board is inserted into the insertion opening, the slider has a support surface, when the slider is at the initial position, the slider-contact portions of the terminal projections are supported on the support surface of the slider so that the terminal projections are resiliently deformed toward the one of the insertion opening surfaces and the contacts are separated from the electrode-formed surface of the circuit board with respect to the second direction, when the slider is at the insertion completed position, the slider-contact portions are completely separated from the slider, the contacts are in contact with the electrodes, and the terminal projections are in a state of applying a spring back force of resilient deformation to the circuit board through the contacts;

the slider has a plurality of grooves corresponding to the slider-contact portions of the terminal projections, and the support surface of the slider is provided by a bottom surface of each of the grooves.

2. The electronic device according to claim 1, wherein at least one of the support surface of the slider and the slider-contact portion of the terminal projection is inclined toward the electrode-formed surface of the circuit board as a function of distance from the second end of the insertion opening.

3. The electronic device according to claim 2, wherein both of the support surface of the slider and the slider-contact portion of the terminal projection are inclined relative to each other.

4. The electronic device according to claim 2, wherein each of the electrodes has a predetermined length with respect to the second direction, each of the contacts is brought into contact with the electrode before the slider-contact portion is completely separated from the slider, and wipes a surface of the electrode until the slider is moved to the insertion completed position.

5. The electronic device according to claim 1, wherein the housing includes a protection wall disposed next to at least one of the terminal projections with respect to the third direction, and the protection wall projects from the insertion opening surface from which the terminal projections project to a position closer to the electrode-formed surface of the circuit board than a position of the contacts supported on the support surface of the slider with respect to the second direction.

6. The electronic device according to claim 5, wherein the protection wall extends from a position closer to the end surface of the housing than the contacts with respect to the first direction, and a surface of the protection wall opposing to the electrode-formed surface of the circuit board is inclined toward the electrode-formed surface of the circuit board as a function of distance from the end surface of the housing.

7. The electronic device according to claim 1, wherein the second end of the insertion opening opens on another end surface of the housing, and the card edge connector further includes a cover member that covers the second end of the insertion opening.

8. The electronic device according to claim 1, further comprising:

a positioning unit that is configured to position the slider at least to the initial position, wherein the positioning unit includes an engagement projection and an engagement recess, the engagement projection is disposed in one of the slider, the terminal projection, and the housing, and is resiliently deformable, the engagement recess is disposed in another one of the slider, the terminal projection and the housing, and the engagement projection is engaged with the engagement recess at least in a state where the slider is at the initial position.

9. The electronic device according to claim 8, wherein the engagement recess includes a first recess portion and a second recess portion, the first recess portion and the second recess portion are arranged in the first direction, the first recess portion is closer to the end surface than the second recess portion, the engagement projection is engaged with the first recess portion in the state where the slider is at the initial position, and the engagement projection is engaged with the second recess portion in a state where the slider is at the insertion completed position.

10. The electronic device according to claim 8, wherein the slider includes a slider body that provides the support surface for supporting the slider-contact portions of the terminal projections, the engagement projection projects from the slider body, and the engagement recess is formed on one of a wall of the housing that provides the insertion opening surface from which the terminal projections projects and a side wall of the housing.

11. The electronic device according to claim 10, wherein the engagement recess is provided by a through hole passing through the one of the wall of the housing and the side wall of the housing.

12. The electronic device according to claim 8, wherein the engagement projection is provided by a part of the slider-contact portion of the terminal projection, and the engagement recess is disposed on the support surface of the slider.

13. The electronic device according to claim 8, wherein the housing has a first stopper inside of the insertion opening to restrict the slider from moving toward the second end of the insertion opening over the insertion completed position.

14. The electronic device according to claim 8, wherein the housing has a second stopper inside of the insertion opening to restrict the slider from moving toward the first end of the insertion opening over the initial position, and the second stopper is disposed at a position without interfering with a movement of the circuit board.

15. The electronic device according to claim 1, wherein the slider-contact portion of the terminal projection is inclined to separate from the electrode-formed surface of the circuit board toward the tip end of the terminal projection, and in a state where the slider-contact portion is completely separated from the slider, the end of the slider-contact portion is located further from the electrode-formed surface of the circuit board than the end of the support surface of the slider with respect to the second direction, the electronic device further comprising a returning unit that is configured to return the slider from the insertion completed position to the initial position with a removal of the circuit board from the insertion opening.

16. The electronic device according to claim 15, wherein the returning unit includes a notch, an arm and a guide portion, the notch is disposed at an end of the circuit board with respect to the third direction, the arm includes a spring portion and a locking portion, the spring portion projects from the slider toward the first end of the insertion opening at a position without contacting the circuit board with respect to the third direction and being resiliently deformable with respect to the second direction, the locking portion extends from the spring portion toward the circuit board to be engaged with the notch when the slider is at the insertion completed position, the guide portion is disposed on a side wall of the housing with respect to the third direction, the guide portion is located closer to the first end of the insertion opening than the spring portion and provides an opposing surface opposing to an end of the spring portion with respect to the first direction, the opposing surface of the guide portion is inclined to approach the insertion opening surface that is opposed to the electrode-formed surface of the circuit board toward the first end of the insertion opening, when the circuit board is pulled from the housing from the state where the slider is at the insertion completed position, the slider is moved toward the initial position with a movement of the circuit board as the locking portion is pushed by a surface of the notch, and the end of the spring portion is brought into contact with the opposing surface of the guide portion, when the circuit board is further pulled from a state where the end of the spring portion is in contact with the opposing surface of the guide portion, the end of the spring portion is moved toward the insertion opening surface along the inclined opposing surface of the guide portion and the locking portion is disengaged from the notch, so that the slider is returned to the initial position and the arm is moved to a first guided position where the end of the spring portion is in contact with the opposing surface of the guide portion and an opposing surface of the locking portion opposing to the electrode-formed surface of the circuit board intersects with a plane including the electrode-formed surface of the circuit board, when the circuit board is further pulled from a state where the arm is at the first guided position, the spring portion is deflected toward the insertion-opening surface by the circuit board and the arm is in a second guided position where the opposing surface of the locking portion is mounted on the electrode-formed surface of the circuit board, and when the circuit board is further pulled from a state where the arm is at the second guided position and moved away from the locking portion, the arm is returned to the first guided position and held at the first guided position.

17. The electronic device according to claim 16, wherein the guide portion is provided by a groove formed on an inner surface of the side wall of the housing, the opposing surface of the guide portion is provided by an end surface of the groove disposed adjacent to the first end of the insertion opening with respect to the first direction, and the arm is partly disposed in the groove.

18. The electronic device according to claim 16, wherein the guide portion is provided by a projection projecting from an inner surface of the side wall of the housing with respect to the third direction.

19. The electronic device according to claim 16, wherein the locking portion includes a first wall portion and a second wall portion, the first wall portion including the opposing surface of the locking portion, and the second wall portion extends from an end of the first wall portion in a direction to which the locking portion moves when the circuit board is pulled, the end being adjacent to the second end of the insertion opening.

20. The electronic device according to claim 19, wherein when the locking portion is at the first guided position, a surface of the second wall portion, which faces the notch portion with respect to the first direction, is inclined to intersect with the plane including the electrode-formed surface of the circuit board.

21. The electronic device according to claim 20, wherein when the slider is at the initial position, the first wall portion of the locking portion is disposed such that the opposing surface of the first wall portion intersects with a plane including a portion of the insertion opening surface, the portion of the insertion opening surface facing the electrode-formed surface of the circuit board with respect to the second direction and being located closest to the center of the insertion opening with respect to the second direction.

22. The electronic device according to claim 21, wherein the first wall portion includes a first section adjacent to the guide portion and a second section adjacent to the second wall portion, and the first section and the second section are angled relative to each other so that an angle defined between the first section and the second wall portion is smaller than an angle defined between the second section and the second wall portion.

23. The electronic device according to claim 21, wherein the first wall portion and the second wall portion form an acute angle therebetween.

24. The electronic device according to claim 19, wherein the locking portion further includes a third wall portion that extends from the second wall portion opposite to the first wall portion, and the third wall portion is opposed to the first wall portion.

25. The electronic device according to claim 15, wherein the returning unit includes a notch, an arm, and a guide portion, the notch is disposed at an end of the circuit board with respect to the third direction, the arm extends from the slider toward the first end of the insertion opening at a position corresponding to the notch with respect to the third direction, the guide portion projects from an inner surface of the housing into the insertion opening, the guide portion overlaps with the end of the circuit board with respect to the third direction and is disposed adjacent to the first end of the insertion opening than the arm with respect to the first direction, the arm includes a spring portion, an inclined end portion and a locking portion, the spring portion is resiliently deformable with respect to the second direction, and is disposed on the electrode-formed surface of the circuit board when the slider is at the insertion completed position, the locking portion extends from the spring portion toward the first end of the insertion opening and is configured to engage with the notch when the slider is at the insertion completed position, the inclined end portion extends from the locking portion in a direction opposite to the spring portion, the inclined end portion includes an inclined surface that is inclined toward the insertion opening surface of the insertion opening as a function of distance from the locking portion, the inclined surface is partly opposed to an opposing surface of the guide portion when the slider is at the insertion completed position, when the circuit board is pulled from the housing from a state where the slider is at the insertion completed position, the slider is moved toward the first end of the insertion opening with a movement of the circuit board as the locking portion is pushed by a surface of the notch, and the inclined surface of the inclined end portion is brought into contact with the opposing surface of the guide portion, and when the circuit board is further pulled from the state where the inclined surface of the inclined end portion is in contact with the opposing surface of the guide portion, the inclined end portion is moved toward the insertion opening surface of the insertion opening along the opposing surface of the guide portion while bending the spring portion with respect to the second direction, so that the locking portion is mounted onto the surface of the circuit board.

26. The electronic device according to claim 16, wherein the locking portion is located in an area outside of the electrodes on the electrode-formed surface of the circuit board with respect to the third direction.

27. The electronic device according to claim 15, wherein one of the slider, the terminal and the housing includes an engagement projection and another one of the slider, the terminal and the housing includes an engagement recess to be engaged with the engagement projection, the engagement projection is resiliently deformable, the engagement recess includes a first recess portion and a second recess portion, the first recess portion and the second recess portion are arranged in the first direction so that the first recess portion is closer to the first end of the insertion opening than the second recess portion, when the slider is at the initial position, the engagement projection is engaged with the first recess portion, and when the slider is at the insertion completed position, the engagement projection is engaged with the second recess portion.

28. The electronic device according to claim 27, wherein the slider includes a slider body that provides the support surface for supporting the slider-contact portions of the terminal projections, the engagement projection projects from the slider body, and the engagement recess is formed on one of a wall of the housing that provides the insertion opening surface from which the terminal projections projects and a side wall of the housing.

29. The electronic device according to claim 1, wherein the electrode-formed surface is disposed on both sides of the edge portion of the circuit board, and the terminal projections project from both the insertion opening surfaces of the insertion opening toward the corresponding electrode-formed surfaces of the circuit board.

30. An electronic device comprising:

a circuit board that has an electrode-formed surface on which a plurality of electrodes are formed at least on one side of an edge portion of the circuit board; and a card edge connector that provides electric connection with the circuit board, the card edge connector including:

a housing defining an insertion opening for receiving the edge portion of the circuit board, the insertion opening having a first end that opens on an end surface of the housing and a second end opposite to the first end, the insertion opening extending in the housing in a first direction, the housing having insertion opening surfaces that are opposed to each other in a second direction perpendicular to the first direction and defines the insertion opening therebetween;

a plurality of terminals including housing-fixed portions fixed in the housing and terminal projections extending from the housing-fixed portions and projecting into the insertion opening from at least one of the insertion opening surfaces, which faces the electrode-formed surface of the circuit board, toward the second end of the insertion opening, the terminal projections being arranged in the insertion opening in a third direction perpendicular to the first direction and the second direction, the terminal projections being resiliently deformable and including contacts to be in contact with the electrodes of the circuit board; and a slider disposed in the insertion opening between the contacts of the terminal projections and the second end of the insertion opening with respect to the first direction, wherein each of the terminal projection includes a slider-contact portion between the contact and a tip end of the terminal projection, the slider is movable from an initial position before the circuit board is inserted into the insertion opening from the first end to an insertion completed position where an insertion of the circuit board is completed when the circuit board is inserted into the insertion opening, the slider has a support surface, when the slider is at the initial position, the slider-contact portions of the terminal projections arc supported on the support surface of the slider so that the terminal projections are resiliently deformed toward the one of the insertion opening surfaces and the contacts are separated from the electrode-formed surface of the circuit board with respect to the second direction, when the slider is at the insertion completed position, the slider-contact portions are completely separated from the slider, the contacts are in contact with the electrodes, and the terminal projections are in a state of applying a spring back force of resilient deformation to the circuit board through the contacts, the electrodes are arranged in a plurality of rows with respect to the second direction and are staggered with respect to the third direction between the rows, the terminals includes plural types of terminals having terminal projections with different length corresponding to the number of rows of the electrodes, and the plural types of terminals are supported by the slider at the same position with respect to the first direction when the slider is at the initial position.

31. An electronic device comprising:

a circuit board that has an electrode-formed surface on which a plurality of electrodes are formed at least on one side of an edge portion of the circuit board; and a card edge connector that provides electric connection with the circuit board, the card edge connector including:

a housing defining an insertion opening for receiving the edge portion of the circuit board, the insertion opening having a first end that opens on an end surface of the housing and a second end opposite to the first end, the insertion opening extending in the housing in a first direction, the housing having insertion opening surfaces that are opposed to each other in a second direction perpendicular to the first direction and defines the insertion opening therebetween;

a plurality of terminal including housing-fixed portions fixed in the housing and terminal extending from the housing-fixed portions and projecting into the insertion opening from at least one of the insertion opening surfaces, which faces the electrode-formed surface of the circuit board, toward the second end of the insertion opening, the terminal projections being arranged in the insertion opening in a third direction perpendicular to the first direction and the second direction, the terminal projections being resiliently deformable and including contacts to be in contact with the electrodes of the circuit board; and a slider disposed in the insertion opening between the contacts of the terminal projections and the second end of the insertion opening with respect to the first direction, wherein each of the terminal projections includes a slider-contact portion between the contact and a tip end of the terminal projection, the slider is movable from an initial position before the circuit board is inserted into the insertion opening from the first end to an insertion completed position where an insertion of the circuit board is completed when the circuit board is inserted into the insertion opening, the slider has a support surface, when the slider is at the initial position, the slider-contact portions of the terminal projections are supported on the support surface of the slider so that the terminal projections are resiliently deformed toward the one of the insertion opening surfaces and the contacts are separated from the electrode-formed surface of the circuit board with respect to the second direction, when the slider is at the insertion completed position, the slider-contact portions are completely separated from the slider, the contacts are in contact with the electrodes, and the terminal projections are in a state of applying a spring back force of resilient deformation to the circuit board through the contacts, the electrodes are arranged in a plurality of rows with respect to the second direction and are staggered with respect to the third direction between the rows, all the terminal projections have the same length with respect to the first direction, and the slider supports the slider-contact portions of the terminal projections at different positions with respect to the first direction corresponding to positions of the rows of the electrodes.

* * * * *